US007140057B2

(12) United States Patent
Hetzel et al.

(10) Patent No.: US 7,140,057 B2
(45) Date of Patent: Nov. 28, 2006

(54) REINFORCED AND ADJUSTABLE CONTOURED SEAT CUSHION AND METHOD OF REINFORCING AND ADJUSTING THE CONTOURED SEAT CUSHION

(75) Inventors: Thomas R. Hetzel, Littleton, CO (US); Aaron D. Pierce, Denver, CO (US); Steve Maurus, Littleton, CO (US)

(73) Assignee: Aspen Seating, LLC, Sheridan, CO (US)

( * ) Notice: Subject to any disclaimer, the term of this patent is extended or adjusted under 35 U.S.C. 154(b) by 0 days.

(21) Appl. No.: 10/766,623

(22) Filed: Jan. 28, 2004

(65) Prior Publication Data

US 2005/0022306 A1 Feb. 3, 2005

Related U.S. Application Data

(63) Continuation-in-part of application No. 10/628,860, filed on Jul. 28, 2003.

(51) Int. Cl.
*A47C 7/14* (2006.01)
*A47C 7/18* (2006.01)

(52) U.S. Cl. ..... 5/653; 297/452.26; 297/452.28

(58) Field of Classification Search ..... 297/452.23, 297/452.26, 452.27, 452.28; 5/653, 654, 5/654.1; D6/502
See application file for complete search history.

(56) References Cited

U.S. PATENT DOCUMENTS

| | | | | |
|---|---|---|---|---|
| 1,309,725 | A * | 7/1919 | Gerstenmaier | 297/452.25 |
| D59,900 | S | 12/1921 | Marsh | |
| 1,742,183 | A | 1/1930 | Claus | |
| 1,961,641 | A | 6/1934 | Ollis | |
| 2,156,629 | A | 5/1939 | Hutchison | |
| 2,384,713 | A | 9/1945 | Varma | |
| 2,472,754 | A | 6/1949 | Mead | |
| D169,366 | S | 4/1953 | Feldman | |
| 2,659,418 | A | 11/1953 | Berman | |
| 2,933,738 | A | 4/1960 | Whelan | |
| 3,158,878 | A | 12/1964 | Pernell | |
| 3,177,036 | A | 4/1965 | Halter | |
| 3,222,694 | A | 12/1965 | Schick | |
| 3,503,649 | A * | 3/1970 | Johnson | 297/452.26 |
| 3,511,537 | A | 5/1970 | Ackermann | |
| 3,749,442 | A | 7/1973 | Berg et al. | |
| D238,235 | S | 12/1975 | Elgebrandt | |
| 3,987,507 | A | 10/1976 | Hall | |

(Continued)

FOREIGN PATENT DOCUMENTS

| | | |
|---|---|---|
| FR | 768163 | 8/1934 |

(Continued)

*Primary Examiner*—Michael Safavi
(74) *Attorney, Agent, or Firm*—John R. Ley

(57) ABSTRACT

A flexible seat cushion, such as a wheelchair cushion, has an upper surface with a support contour for establishing relatively less pressure on skin adjacent to the bony prominences of the person's pelvic area and relatively more pressure on skin covering adjacent tissue masses. A support member is attached to the rear corner of the cushion. The support member has relatively less flexibility than the seat cushion. The support member is retained to a longitudinal and/or transverse side of the cushion to cause the support member to resist deformation of the support contour from contact with the pelvic area of the person when seated on the seat cushion. Connector member may be connected to the support member to extend along longitudinal and/or transverse sides of the cushion to deform and thereby adjust the support contour for better support of the pelvic area.

34 Claims, 21 Drawing Sheets

U.S. PATENT DOCUMENTS 4,132,228 A 1/1979 Green
4,327,046 A 4/1982 Davis et al.
4,347,213 A 8/1982 Rogers, Jr.
D278,779 S 5/1985 Sink
4,522,447 A 6/1985 Snyder et al.
4,567,887 A 2/1986 Couch, Jr.
4,588,229 A 5/1986 Jay
4,615,856 A 10/1986 Silverman
4,643,481 A 2/1987 Saloff et al.
D289,481 S 4/1987 Reddick
4,682,818 A 7/1987 Morell
4,726,624 A 2/1988 Jay
4,753,480 A 6/1988 Morell
4,756,090 A 7/1988 Pedrow
4,824,174 A 4/1989 Dunn, Sr.
4,828,325 A * 5/1989 Brooks ..... 297/452.28
4,842,330 A 6/1989 Jay
4,889,387 A 12/1989 Gregory
4,890,235 A 12/1989 Reger et al.
4,912,788 A 4/1990 Lonardo
4,951,334 A 8/1990 Maier
4,972,351 A 11/1990 Reger et al.
4,998,354 A 3/1991 Silverman et al.
5,018,790 A 5/1991 Jay
D318,923 S 8/1991 Marsh
5,079,790 A 1/1992 Pouch
5,092,655 A 3/1992 Deegener et al.
5,163,737 A 11/1992 Navach et al.
5,180,619 A 1/1993 Landi et al.
5,189,747 A 3/1993 Mundy et al.
5,193,285 A 3/1993 Heinrich et al.
D335,235 S 5/1993 Hildreth
5,255,404 A 10/1993 Dinsmoor, III et al.
D342,411 S 12/1993 Graebe
5,282,286 A 2/1994 MacLeish
5,288,135 A 2/1994 Forcier et al.
5,294,181 A 3/1994 Rose et al.
5,317,773 A 6/1994 Graebe
5,333,921 A 8/1994 Dinsmoor, III
5,343,876 A 9/1994 Rogers
5,352,023 A 10/1994 Jay et al.
5,369,829 A 12/1994 Jay
5,378,045 A 1/1995 Siekman et al.
5,390,384 A 2/1995 Dinsmoor, III et al.
5,395,162 A 3/1995 Jay et al.
5,397,517 A 3/1995 Jay et al.
5,414,884 A 5/1995 Mackenzie
5,442,823 A 8/1995 Siekman et al.
5,444,881 A 8/1995 Landi et al.
5,452,940 A 9/1995 Maier
5,457,833 A 10/1995 Jay
5,461,741 A 10/1995 Graebe
5,470,590 A 11/1995 Brubaker et al.
5,490,299 A 2/1996 Dinsmoor, III et al.
5,496,610 A 3/1996 Landi et al.
5,513,899 A 5/1996 Michaels et al.
5,522,106 A 6/1996 Harrison et al.
5,524,971 A 6/1996 Jay et al.
5,551,107 A 9/1996 Graebe
5,551,756 A 9/1996 Gurasich et al.
5,592,707 A 1/1997 Dinsmoor, III et al.
5,613,256 A 3/1997 Hanson
5,613,257 A 3/1997 Graebe
5,617,595 A 4/1997 Landi et al.
5,671,977 A 9/1997 Jay et al.
5,681,092 A 10/1997 Hanson et al.
5,687,436 A 11/1997 Denton
5,836,025 A 11/1998 Poncy, Sr.
5,840,400 A 11/1998 Landi et al.
5,845,352 A 12/1998 Matsler et al.
5,920,915 A 7/1999 Bainbridge et al.
6,018,832 A 2/2000 Graebe
6,032,300 A 3/2000 Bainbridge et al.
6,055,676 A 5/2000 Bainbridge et al.
6,082,824 A 7/2000 Chow
6,161,238 A 12/2000 Graebe
6,182,314 B1 2/2001 Frydman
6,241,320 B1 6/2001 Chew et al.
6,293,026 B1 9/2001 Lee et al.
6,293,625 B1 9/2001 Dixon
6,301,722 B1 10/2001 Nickerson et al.
6,345,401 B1 2/2002 Frydman
6,357,054 B1 3/2002 Bainbridge et al.
6,453,477 B1 9/2002 Bainbridge et al.
6,493,958 B1 12/2002 Tadin
6,502,263 B1 1/2003 Rowley et al.
6,611,980 B1 9/2003 Wempe
6,625,897 B1 9/2003 Tadin
2001/0013146 A1 8/2001 Wempe
2002/0014794 A1 2/2002 Chow
2003/0121103 A1 7/2003 Wempe

FOREIGN PATENT DOCUMENTS

GB 2016918 10/1979

* cited by examiner

REINFORCED AND ADJUSTABLE CONTOURED SEAT CUSHION AND METHOD OF REINFORCING AND ADJUSTING THE CONTOURED SEAT CUSHION

CROSS-REFERENCE TO RELATED APPLICATIONS

This invention is a continuation in part of U.S. patent application Ser. No. 10/628,860, filed Jul. 28, 2003, for a Contoured Seat Cushion and Method for Offloading Pressure from Skeletal Bone Prominences and Encouraging Proper Postural Alignment. This invention is also related to other inventions made by at least one of the inventors herein for Individually-Contoured Seat Cushion and Shape Capturing and Fabricating Method for Seat Cushion described in U.S. patent application Ser. No. 10/628,858, and for Modular Seat Cushion with Interlocking Human Support and Base Portions and Method of Creating and Using a Seat Cushion described in U.S. patent application Ser. No. 10/628,859, and for Apparatus and Method for Evaluating Clearance from a Contoured Seat Cushion described in U.S. patent application Ser. No. 10/628,890, were filed on Jul. 28, 2003, and all of which are assigned to the assignee of the present invention. The subject matter of these applications is incorporated herein by reference.

FIELD OF THE INVENTION

This invention relates to seat cushions, and more particularly, to a new and improved seat cushion having a reinforced and adjustable support contour which avoids or reduces the incidence of pressure ulcers while simultaneously orienting the user toward maintaining proper posture. The support contour offloads or isolates pressure and shear forces from skin tissue surrounding the bony prominences of the pelvic skeletal bone structure, such as the ischial tuberosities, greater trochanters, coccyx and sacrum, thereby removing pressure and shear forces from those areas which are susceptible to injury from prolonged sitting. Proper postural alignment is achieved by transferring the pressure from the offloaded areas to greater masses of tissue not associated with bony prominences, such as the proximal thighs and the posterior lateral buttocks. The additional support from these areas encourages improved postural alignment and control.

BACKGROUND OF THE INVENTION

A wheelchair seat cushion must perform a number of important functions. The seat cushion should be comfortable and capable of providing proper support for optimal posture and posture control for a considerable length of time. The seat cushion should also assist, or at least not materially hinder, the user in maneuvering the wheelchair, permit a useful range of motion from the pelvis and upper torso of the person, and create stability and security for the person within the wheelchair. Perhaps most importantly, the seat cushion should help prevent and reduce the incidence of pressure ulcers created by prolonged sitting on the cushion without adequate pressure relief. Pressure ulcers can become a very serious health problem for individuals who must remain constantly in contact with the support cushion, and it is important to avoid such pressure ulcers.

Wheelchair users, like everyone, are of substantially different sizes, weights and shapes. Many wheelchair users have physical disabilities and associated posture and postural control impairments such as those typically caused by congenital disorders. Other wheelchair users, such as those who have been disabled by acquired or traumatic injuries, may have a more typical size and shape. In all of these cases, the support contour of the wheelchair seat cushion must safely support the anatomy of the user, whether the anatomy is abnormal or more typical. Wheelchair seat cushions must fit and perform properly to prevent further physical impairment and pressure ulcers. The cushion must also enhance the functional capabilities of the user by supporting independence in activities of daily living. There are a number of different theories or approaches for configuring the support contour of a wheelchair seat cushion to avoid pressure ulcers and to provide adequate postural alignment.

One approach to configuring the support contour of a wheelchair seat cushion is a single generic support contour which attempts to accommodate all types of pelvic bone-structure configurations, whether more abnormal or more typical. In general, this generic approach involves using a soft, flowable or adaptable material, such as air or gel, as the support material within the wheelchair cushion. This adaptable material adjusts and redistributes in response to the weight and shape of the user to create a support contour which conforms to the anatomy of the user. By conforming to the anatomy of the user, the pressure on the skin of the user is usually distributed relatively evenly over the area of contact. The extent of the uniform pressure distribution depends on the capability of the cushion to accept and conform to the user's anatomy without displacing the adaptable material and resulting in firm contact with a support structure.

The substantially equal pressure distribution is theorized to reduce the incidence of pressure ulcers, by decreasing peak pressures on the skin in the pelvic area associated with bony prominences, most notably the ischial tuberosities, coccyx, sacrum, and greater trochanters. However, as individuals age with their disabilities, the quality of their skin is further compromised in its ability to tolerate pressure and shear forces. The decreased tolerance for pressure and shear forces, no matter how well those forces are distributed, increases the incidence of pressure ulcers.

Generic seat cushions which use flowable support material are usually incapable of providing adequate postural alignment. In general terms, adequate postural alignment is assisted by using the support contour of the seat cushion to encourage proper posture by providing a foundation for dynamic posture control. To do so, the support contour must have the capability of applying some support pressure to the pelvic area because alignment of the pelvic area is fundamental for proper posture. The adaptable support material of generic seat cushions is intended to move and redistribute itself, and consequently, is generally unstable and incapable of applying the support pressure or force in certain areas of the pelvic anatomy to optimize postural control and alignment.

Many of the disadvantages associated with generic wheelchair cushions may be overcome by using a custom wheelchair seat cushion having a support contour constructed specifically to accommodate the individual anatomical aspects of a particular user. In such cases, it is necessary to capture the anatomical shape of the individual which will contact the custom seat cushion, and then use that anatomical shape to make the custom seat cushion.

The cost of fabricating a custom wheelchair seat cushion can be substantial, for example, approximately $3000 or more. Much of the expense of a custom wheelchair seat cushion results from the amount of time consumed, and the cost of the relatively sophisticated equipment which must be used to capture and transfer the anatomical shape of the user into the support contour of the seat cushion. Moreover, despite the use of sophisticated equipment, it is nevertheless difficult to capture the anatomical shape of the user and transfer it into a customized support contour. An appreciation of some of these difficulties in creating customized wheelchair seat cushions is discussed in the above-referenced U.S. patent application Ser. No. 10/628,858.

The most prevalent approach used to configure the support contour of a custom cushion, at least at the time of filing hereof, is to distribute the weight of the user substantially uniformly over the entire support contour. The uniform pressure distribution is theorized to reduce the incidence of pressure ulcers because the uniform pressure distribution is thought to avoid localized high-pressure points which could give rise to pressure ulcers. The substantial conformance of the support contour to the anatomical shape of the user is also believed to orient the user toward proper postural alignment.

Even if the support contour of the custom cushion is initially satisfactory to the user, changes in tissue and musculature may dictate changes in the optimal support contour of the custom seat cushion. Tissue will typically atrophy over time, particularly for first-time wheelchair users. Tissue atrophy and other tissue changes alter the pressure distribution over the support contour. Those changes may result in increased pressure on tissues surrounding the bony prominences, thereby ultimately increasing the risks of pressure ulcers. Moreover, as the muscle strength diminishes, the user relies more on the support contour of the seat to hold the proper posture. In doing so, parts of the pelvic anatomy press more directly on certain parts of the support contour as a foundation for postural alignment. The increased pressure from postural alignment increases the pressure and shear forces on the skin in those areas, again increasing the risk of pressure ulcers. In general, the concept of equally distributing the pressure over the entire support contour of the custom seat cushion is generally obtainable only for a limited amount of time and under limited circumstances. Additionally, any movement of the user, or even subtle changes in pelvic orientation on the support contour, can result in substantial increases in pressure and shear forces on the skin at the interface with the support contour.

One type of existing wheelchair cushion includes a cutout area adjacent to the tailbone or sacrum in the pelvic area. This cutout area is effective in eliminating pressure or shear forces which could cause pressure ulcers on the skin surrounding the sacrum. However, the single cutout area does not address the increased pressure and shear forces which occur at the areas of other bony prominences in the pelvic area. Moreover, the support contour of the cushion with the cutout area does not attempt to transfer support to other pelvic areas to compensate for the reduced support at the cutout area. This type of cushion is not generally intended to encourage or bias the pelvic area into alignment for proper posture. Instead, this type of cushion is intended to be used with a separate back support cushion in order to invoke postural alignment. In addition, this type of cushion is also subject to the problems arising from tissue loss and incorrect sizing.

In those types of existing wheelchair cushions having individualized support contours intended to interact with the anatomy of a specific user, slight discrepancies in capturing the shape of the individualized support contour may be compensated for by adding shims or other additional external support structures to the seat cushion or to a structural base upon which the cushion resides. In general, adding the additional shims or support structures is relatively imprecise in achieving the desired effect, and requires considerable time and effort due to the number of trial fittings that are typically required. A similar situation exists with respect to anatomical changes that occur after the cushion has been used for some amount of time. In both circumstances, the support capabilities of the cushion are decreased by the trial and error approach to correcting for shape-capturing discrepancies and anatomical changes. Furthermore, the added shims and external support structures complicate the use of the cushion, because those added parts must be kept in alignment with the cushion when in use.

In those types of existing wheelchair cushions which establish an individualized or specific support contour, certain areas of the support contour may be subject to excessive deformation of the somewhat flexible material from which the cushion is constructed. The wheelchair cushions must be constructed of material which offers some amount of flexibility or resiliency, in order to function adequately as a cushion. The material which provides that flexibility or resiliency is subject to deformation when the support contour includes areas of significant curvature or areas which apply transverse support on the anatomical structure of the user, because those portions of the support contour may have generally thinner dimensions than the portions of the seat cushion directly beneath the user. Excessively flexible portions of the wheelchair cushion, or portions which may become excessively flexible through use overtime, will not be capable of providing pelvic orientation and alignment as may be required by the wheelchair user.

Because of these and other deficiencies, seat cushions with inadequate support may be used long past the time when they have become ineffective in providing proper support, either because of the cost associated with replacement of the cushion or the failure of the user to recognize the problem until pressure ulcers or other difficulties appear.

Many of the same considerations applicable to wheelchair seat cushions also apply with varying levels of criticality to other types of seat cushions used in other seating environments and applications. For example, seat cushions used in office environments are required to support the user in a comfortable manner and in a manner which encourages proper posture and without creating risks of medical problems, for example inducing blood circulatory problems.

SUMMARY OF THE INVENTION

The present invention involves reinforcing and adjusting a support contour for a seat cushion to obtain the best conditions for isolating and offloading pressure and shear forces from the skin surrounding the bony prominences of the pelvic area skeletal structure and for transferring greater pressure and providing firmer support to areas of the anatomy which have broader masses of soft and muscle tissue not surrounding bony prominences. Offloading or isolating the pressure and shear force from the skin surrounding the bony prominences of the pelvic skeletal structure reduces the risk of pressure ulcers. Transferring pressure and providing pronounced support to broad tissue masses encourages better balance and alignment. The support pressure is applied to those broader and more distributed skeletal areas which are capable of withstanding increased pressure without substantially increasing the risk of pressure ulcers. The greater support pressure is applied to and maintained on those areas which bias, orient or encourage alignment of the pelvic structure toward proper postural alignment. By off-loading the pressure and shear forces from those areas which are prone to skin ulcers, and transferring support pressure to those areas which encourage proper postural alignment, the support contour of the seat cushion simultaneously achieves the two most important wheelchair cushion functions: avoidance of pressure ulcers, and postural alignment and control.

The ability to adjust the support contour offered by the present invention also accommodates tissue changes and atrophy without substantially diminishing its essential functions of avoiding pressure ulcers and encouraging proper postural alignment. Offloading the pressure from the bony prominences of the pelvic area is achieved primarily by increasing the space or clearance between the support contour and the bony prominences. The increased space or clearance inherently absorbs and compensates for a reasonable range of tissue and musculature changes in the pelvic area while maintaining adequate clearance. The areas of increased pressure and support are the areas where pressure should be applied for proper postural alignment in a manner somewhat independent of the amount of tissue in those locations. Therefore, the added support in those areas is likely to remain effective even as the tissue in those areas may atrophy. The adjustment and reinforcement capabilities offered by the present invention assure that the areas of greater support in the support contour are effective and will remain effective for a longevity of use, even under conditions of tissue changes and atrophy. Moreover, the adjustment capability of the present invention may be quickly and effectively achieved, in many cases with the wheelchair user remaining seated on the cushion. In some circumstances, the wheelchair user may actually make the adjustments, rather than require the services of a therapist or technician to do so.

The adjustment capability of the support contour also makes the cushion adaptable to a wider range of variations in the size and shape of the normal human anatomy, primarily as a result of the additional clearance in the areas of the bony prominences and the additional support in the areas of broader tissue and muscular masses. The greater relief or clearance in the areas of the bony prominences and the greater support in the areas of broader tissue and muscular mass, makes the support contour generally applicable to classes of individuals having generally similar pelvic anatomies. Only a few different seat cushions, each having the capability to adjust their proportions, may prove adequate to support a substantial population of wheelchair and other users having typical pelvic anatomies. Consequently, the production of seat cushions embodying the present invention in only a few different sizes, each with adjustment capabilities, may obtain the type of significant benefits for a broad population of users which have previously been reserved to more costly custom seat cushions.

These and other features and aspects of the invention are realized in a flexible seat cushion for supporting a person in a seated position. The seat cushion includes a seat support structure which has longitudinal sides that intersect with transverse front sides at front corners and rear sides that intersect with the longitudinal sides at rear corners. An upper surface extends between the sides and defines a support contour for contacting and supporting the person in a sitting position. The support contour has a relief area located adjacent to skin covering at a bony prominence of the person's pelvic area. The support contour also has a support area that is adjacent to skin covering tissue masses adjacent to the bony prominence. The relief and support areas are spaced relative to the bony prominences so that relatively more pressure is applied to the skin in areas of broader tissue masses and relatively less pressure is applied to the skin in the areas of the bony prominences. Relief and support areas are part of a center cavity that is located toward the rear side of the support contour adjacent to the rear corners. The center cavity preferably has relief areas that are positioned adjacent to skin covering the ischial tuberosities, the greater trochanters and the coccyx and sacrum of a pelvic area of the person sitting on the support contour. The support contour also has support areas that are positioned adjacent to skin covering tissue masses on opposite lateral sides of the posterior buttocks and beneath the proximal thighs of the person.

A support member is positioned at a corner where a longitudinally-extending and a rear transversely-extending sides intersect. The support member is relatively less flexible than the seat support structure and resists deformation of the support contour when the support contour is contacted by the person seated on the seat cushion. The support member is connected to a longitudinally extending side of the seat support structure with a longitudinal connector member at a position longitudinally spaced from the corner where the support member is located. The longitudinal connector member restrains the support member to resist longitudinal deformation of the support contour at the corner where the support member is located. Alternatively or in addition the support member is connected to a rear transverse extending side of the seat support structure with a transverse connector member at a position transversely spaced from the corner where the support member is located. The transverse connector member restrains the support member to resist transverse deformation of the support contour at the corner where the support member is located.

Other features and aspects of the invention involve a method of supporting a person in a seated position. The person is positioned on a support contour defined by a seat support structure of a seat cushion. The seat support structure is formed of resilient flexible material, and has generally transversely spaced and longitudinally extending longitudinal sides and generally longitudinally spaced and transversely extending transverse sides. The sides intersect one another at corners and an upper surface extends between the sides and defines the support contour. The support contour includes a cavity portion to receive the pelvic area of the user. Relief areas are located adjacent to skin covering bony prominences of the pelvic area. The support contour also includes support areas adjacent to skin covering tissue masses spaced from the bony prominences. The seat support structure also includes a support member that is located at a corner adjacent to the cavity. The support member has relatively less resilience than the seat support structure. The method also includes positioning the seat support structure with the support areas at locations adjacent to the tissue masses, and positioning the seat support structure with the relief areas at locations adjacent to the bony prominences. The resilient seat support structure and the support areas of the support contour are restrained against outward deformation away from the pelvic area by retaining the support member to at least one of the longitudinal or transverse sides of the seat support structure at a position spaced from the intersection of the sides at the corner where the support member is located.

A more complete appreciation of the scope of the invention and the manner in which it achieves the above-noted and other improvements can be obtained by reference to the following detailed description of presently preferred embodiments taken in connection with the accompanying drawings, which are briefly summarized below, and by reference to the appended claims.

DETAILED DESCRIPTION

Figure 1:
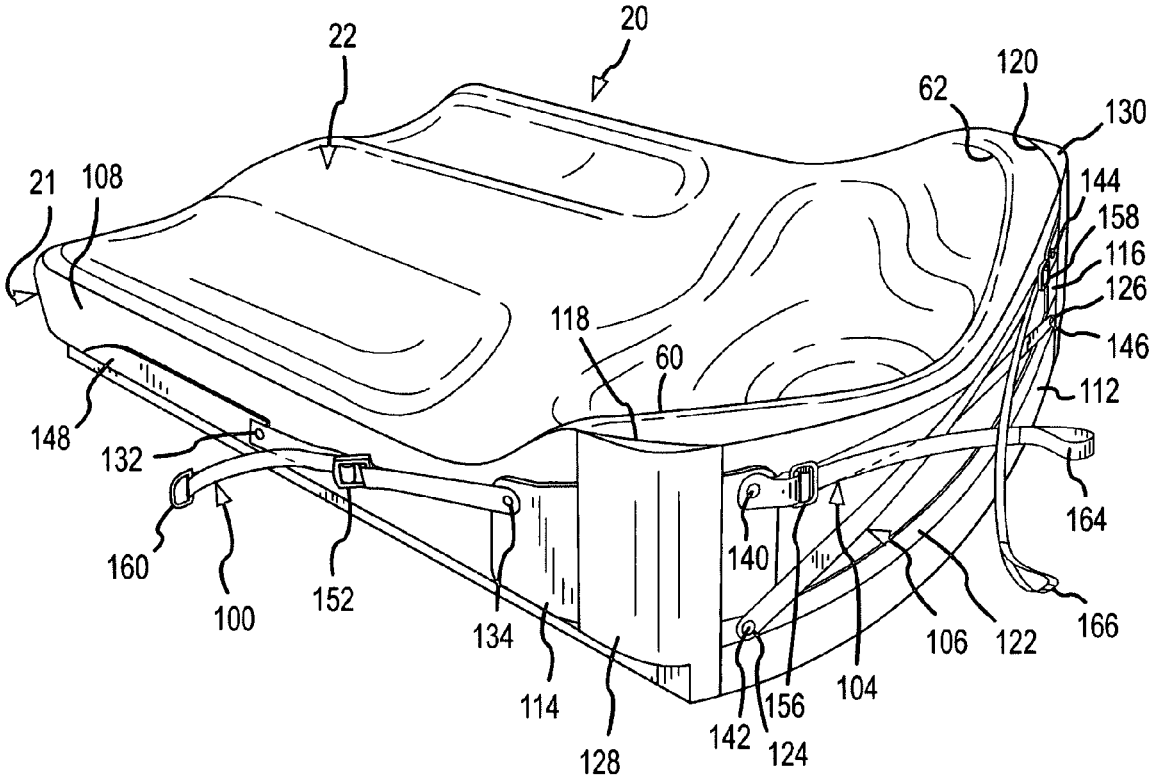
FIG. 1 is a perspective view of a contoured wheelchair or other seat cushion which incorporates the present invention.

A wheelchair seat cushion 20 which incorporates the present invention is shown in FIG. 1. The seat cushion 20 includes a resilient seat support structure 21 which is constructed of resilient plastic foam material that is capable of providing the necessary resilience and support to the wheelchair user. A support contour 22 is preferably constructed or otherwise molded as a part of the support structure 21. Preferably, the resilient plastic foam material from which the support structure 21 is formed is a matrix of polypropylene, polyurethane, polyethylene or other plastic beads which have been adhered together during a molding process in which the support contour 22 is formed simultaneously with the support structure 21, as described more completely in the above-referenced U.S. patent application Ser. No. 10/628,858.

As described in the above-referenced U.S. patent application Ser. No. 10/628,860, the support contour 22 is preferably configured in relation to the particular anatomical shape of the user. In those circumstances, the support contour 22 should provide the improved support characteristics described below. In some circumstances, it may be necessary to make slight adjustments to that support contour to achieve the maximum benefit. Moreover, because of changes which occur over time in the anatomical structure of the user, adjustments to the support contour 22 may be necessary at different times during the use of the seat cushion 20. In those circumstances where a standardized form of the support contour 22 is to be adapted to a particular user, it will generally be necessary to make slight adjustments in that support contour to achieve the best adaptation of the standardized support contour 22 to the particular anatomical characteristics of an individual user.

The present invention offers an improved capability to adjust the support contour 22 of the seat cushion 20. As shown in FIGS. 1, 2 and 10–12, adjustment is accomplished by the use of connector members, such as straps 100, 102, 104 and 106 that attach along the sides of the seat cushion 20. Straps 100 and 102 are attached to the transversely opposite and longitudinally-extending sides 108 and 110 of the seat cushion 20, while the straps 104 and 106 are attached at the rear transversely-extending side 112 of the seat cushion 20. The straps 100 and 104 connect with a relatively stiff corner support member 114 which is located at the transverse rear corner 118 of the seat cushion 20 at the intersection of the sides 108 and 112. The straps 102 and 106 connect with another relatively stiff corner support member 116 which is located at the other transverse rear corner 120 of the seat cushion 20 at the intersection of the sides 110 and 112. The corner support members 114 and 116 are pivotally attached at their bottom ends to opposite ends of a transverse brace 122 which extends along the rear side 112.

Adjusting the length of one or more of the straps 100, 102, 104 and 106 individually forces each of the corner support members 114 and 116 in a longitudinally-forward direction, in a transversely-inward direction, or in both a longitudinally-forward and transversely-inward direction, to adjust the support contour 22 to better accommodate the tissues, musculature and skeletal structure of the wheelchair user. The adjustments may be useful to obtain the best initial fitting or to accommodate changes in the tissue and musculature of the user that occur after the initial fitting. In addition, the relatively less flexible corner support members 114 and 116 reinforce the relatively more flexible material of the seat cushion 20 to help maintain the desired support contour 22, particularly at those locations near the rear transverse corners 118 and 120 where there is more vertical curvature to the support contour 22 and the thicknesses of the walls of the seat cushion 20 are relatively less. The benefits of maintaining and changing the support contour 22 obtained by the adjustments of the straps 100, 102, 104 and 106 and the corner support members 114 and 116, are described more completely below in conjunction with FIGS. 1, 2 and 10–24. The characteristics of the support contour 22, and the benefits which those characteristics obtain in supporting a wheelchair user, are described more completely below in conjunction with FIGS. 3–9.

Details of the support contour 22 are described primarily in conjunction with FIGS. 3–9. The support contour 22 faces upward to contact and support the tissues of the user which surround the skeletal structure of the pelvic area 24 and the thigh bones 26 of the user, as shown in FIGS. 3–9. The support contour 22 includes a relatively deep center cavity 28 which is positioned in the support contour 22 to be located directly below ischial tuberosities 30 of the pelvic area skeletal structure 24, when the user is seated on the cushion 20. The ischial tuberosities 30 are sometimes referred to in common language as the "sit bones." An individual of relatively normal posture and anatomy sits on his or her ischial tuberosities. An individual with normal posture and anatomy is usually supported substantially only from his or her ischial tuberosities 30 when that person is seated on a horizontal substantially rigid surface.

Figure 9:
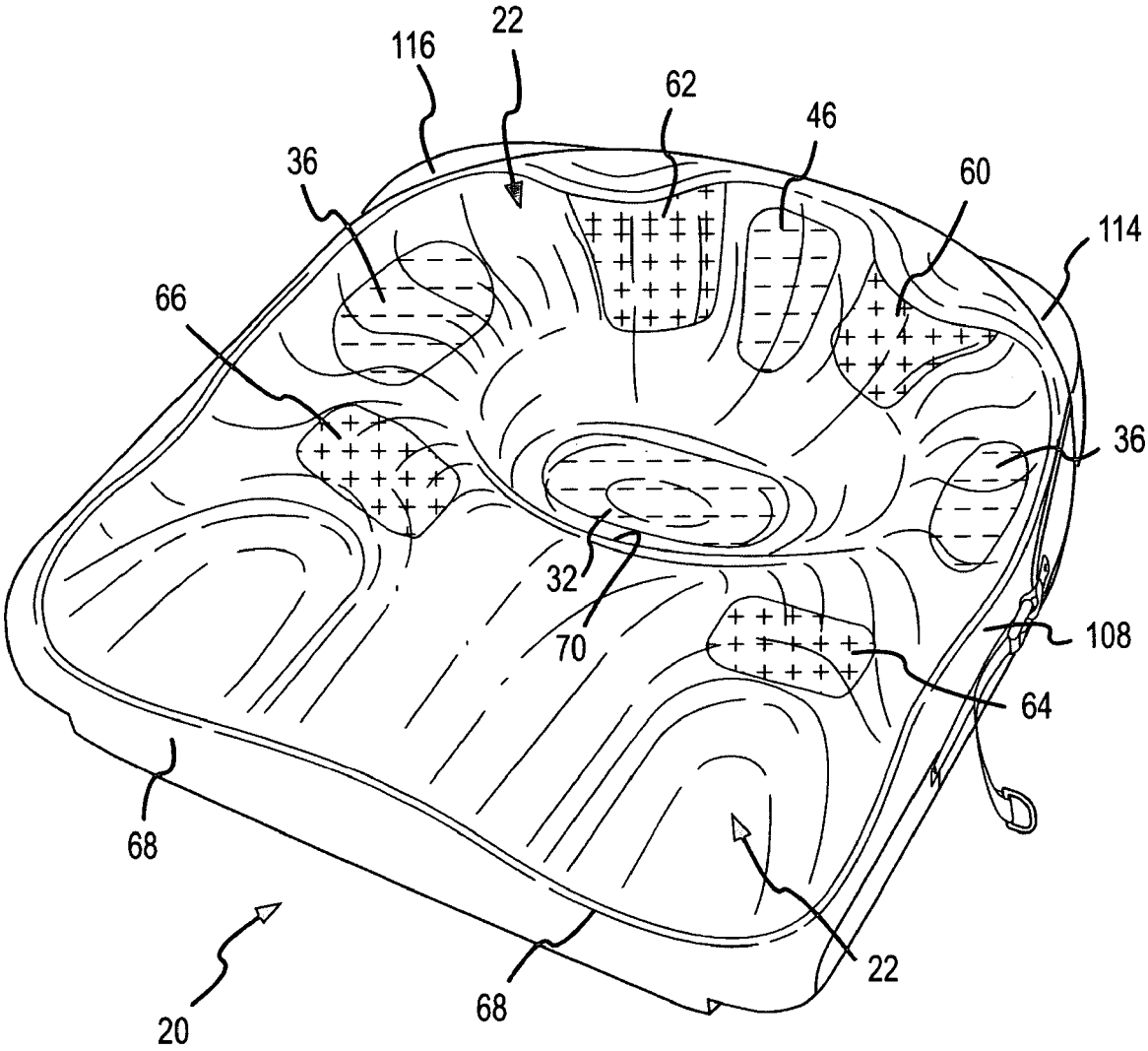
FIG. 9 is a perspective view similar to FIG. 3, with shading and crosshatching to illustrate areas of the support contour where pressure is offloaded and areas where additional support is provided.
Figure 10:
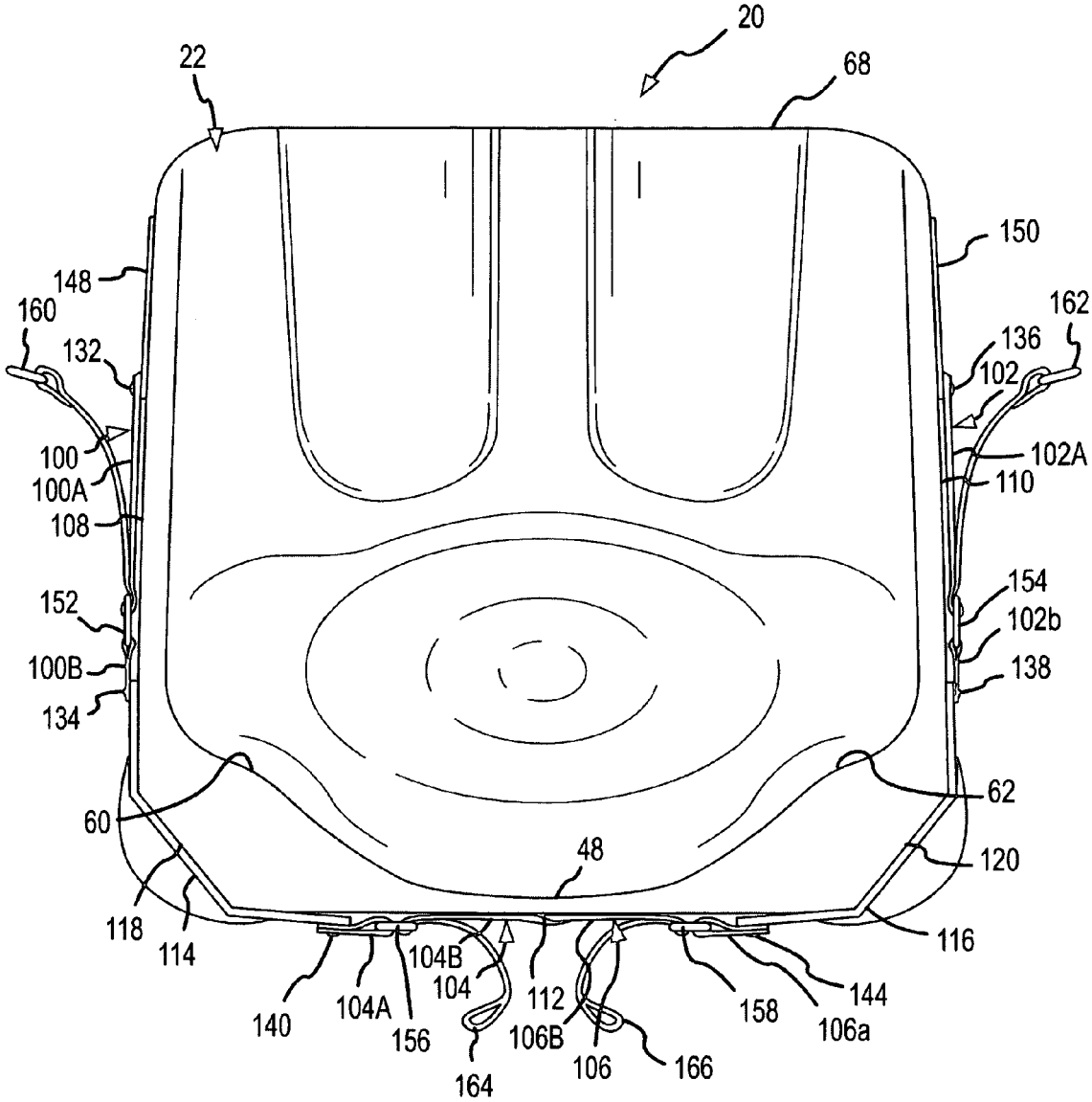
FIG. 10 is a top plan view of the seat cushion shown in FIG. 1.

In the support contour 22, the vertical depth and horizontal dimensions of the cavity 28 are sufficient to offload pressure and shear force from the skin surrounding the ischial tuberosities 30. In order to offload pressure and shear force from the skin surrounding the ischial tuberosities 30, the cavity 28 extends downward to a lowermost portion represented by a generally horizontal lowermost surface area 32. The depth of the cavity 28 is sufficient to establish a vertical clearance 34 between the lower ends of the ischial tuberosities 30 and the lowermost surface area 32, as shown in FIGS. 4, 5 and 9.

Figure 4:
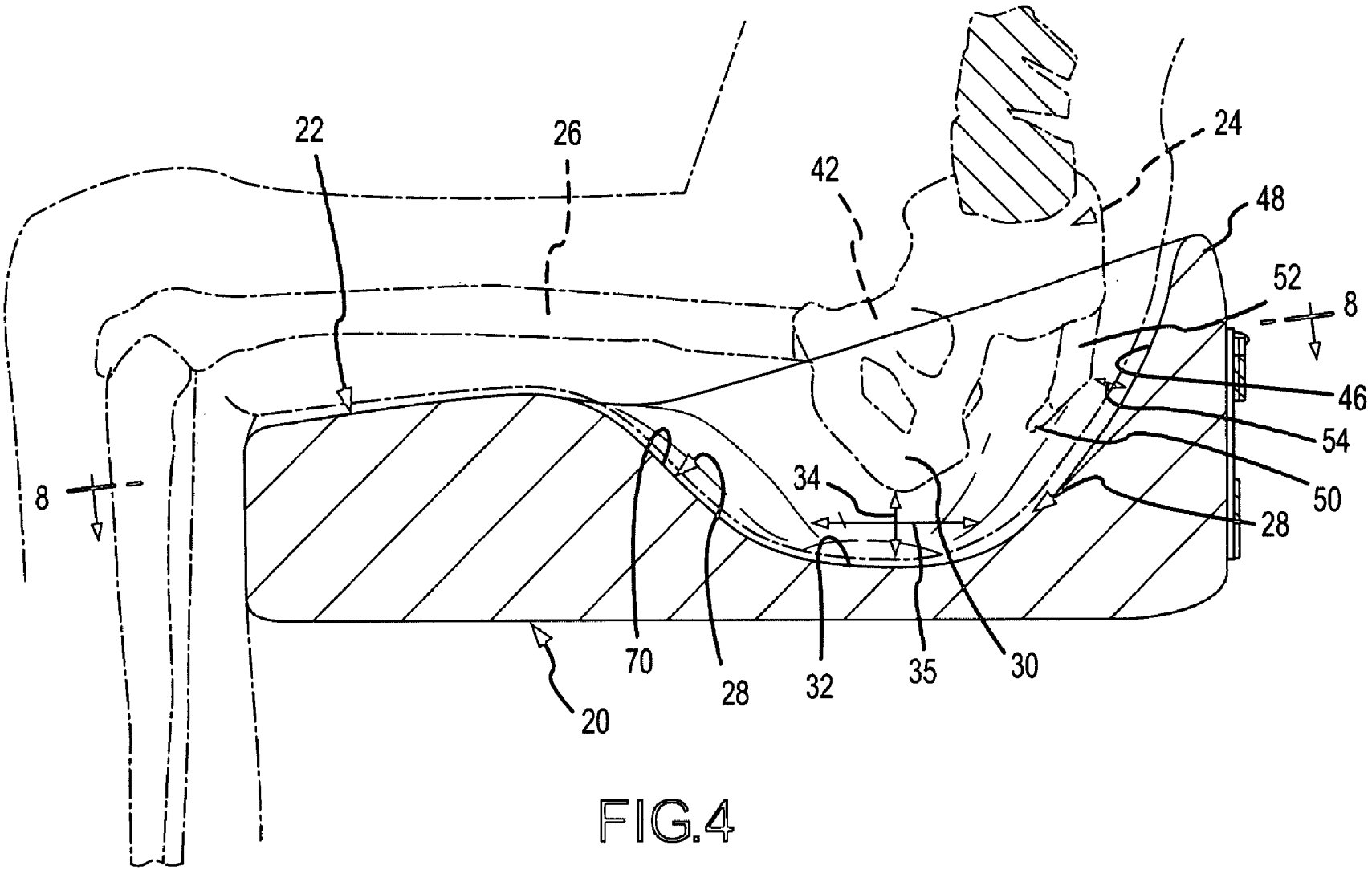
FIG. 4 is a midline longitudinal and vertical cross-sectional view taken substantially in the plane of line 4—4 of FIG. 3.

As shown in FIG. 4, the longitudinal extent of the lowermost surface area 32 extends the clearance 34 over a longitudinal range 35 sufficient to accommodate the normal forward and backward movement of the lower ends of the ischial tuberosities 30. Normal forward and backward pivoting movement of the upper torso of the user will cause the lower ends of the ischial tuberosities 30 to move forward and backward. The depth and shape configuration of the support contour 22 at the lowermost surface area 32 assures that sufficient longitudinal clearance 35 to accommodate this typical forward and backward movement of the lower ends of the ischial tuberosities 30.

Figure 5:
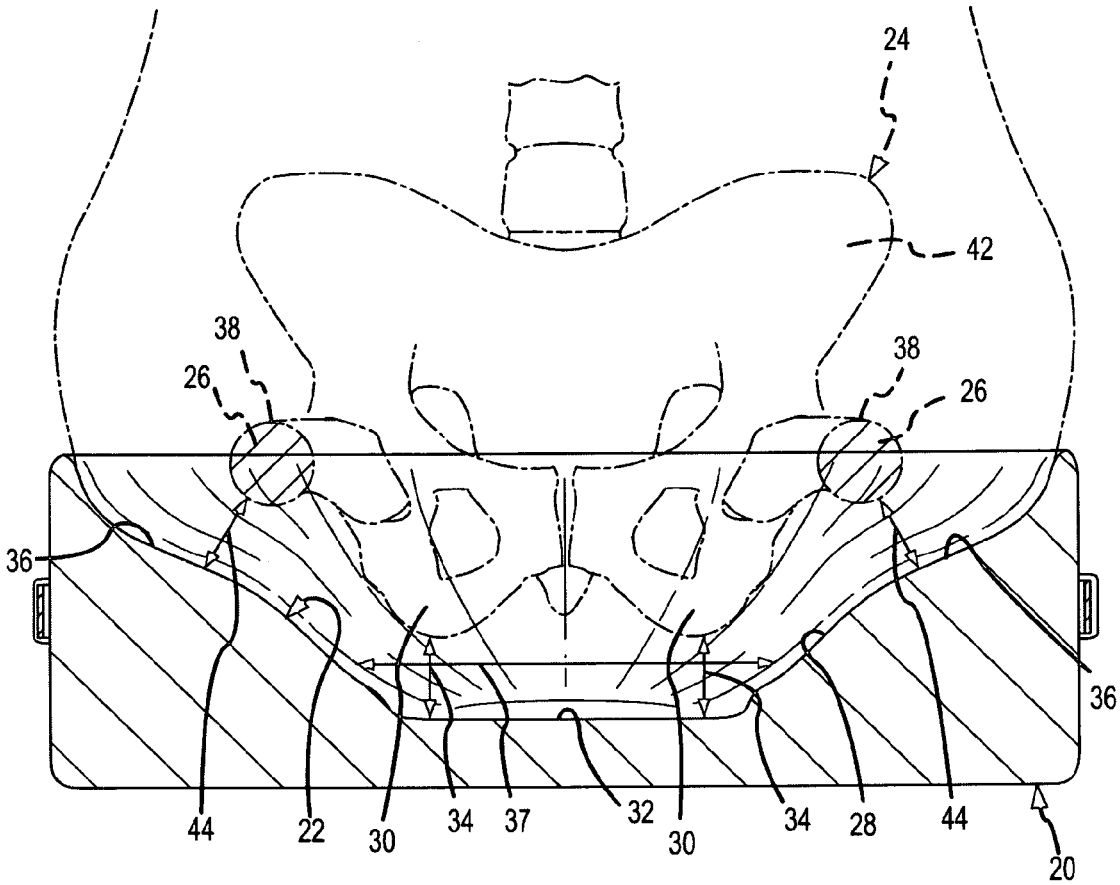
FIG. 5 is a transverse and vertical cross-sectional view taken substantially in the plane of line 5—5 of FIG. 3.

As shown in FIG. 5, the lowermost surface area 32 also extends a transverse distance within the cavity 28 to create a transverse clearance 37 beyond the lower ends of the ischial tuberosities 30. The extent of the lowermost surface area 32 assures a sufficient amount of transverse clearance 37 to accommodate a normal range of side to side movement of the upper torso during typical activity such as extending an arm to one side of the upper torso when reaching for an object. The pelvic area skeletal structure 24 may pivot slightly laterally in this case, causing one of the ischial tuberosities 30 to elevate and the other to descend slightly. The depth of the lowermost surface area 32 also provides sufficient vertical clearance 34 to accommodate this type of tilting.

The extent of the vertical clearance 34, the longitudinal clearance 35 and the transverse clearance 37, as established by the depth of the cavity 28 and the horizontal extent of the lowermost surface area 32, offloads pressure and shear forces from the skin and other tissue surrounding the ischial tuberosities 30. The pressure and shear forces are offloaded under both static sitting conditions, and under conditions of dynamic movement while in the seated position. By offloading the pressure and shear force from the skin surrounding the ischial tuberosities 30 due to the clearances 34, 35 and 37, the risk of pressure ulcers on the skin surrounding the ischial tuberosities 30 is reduced substantially.

Figure 3:
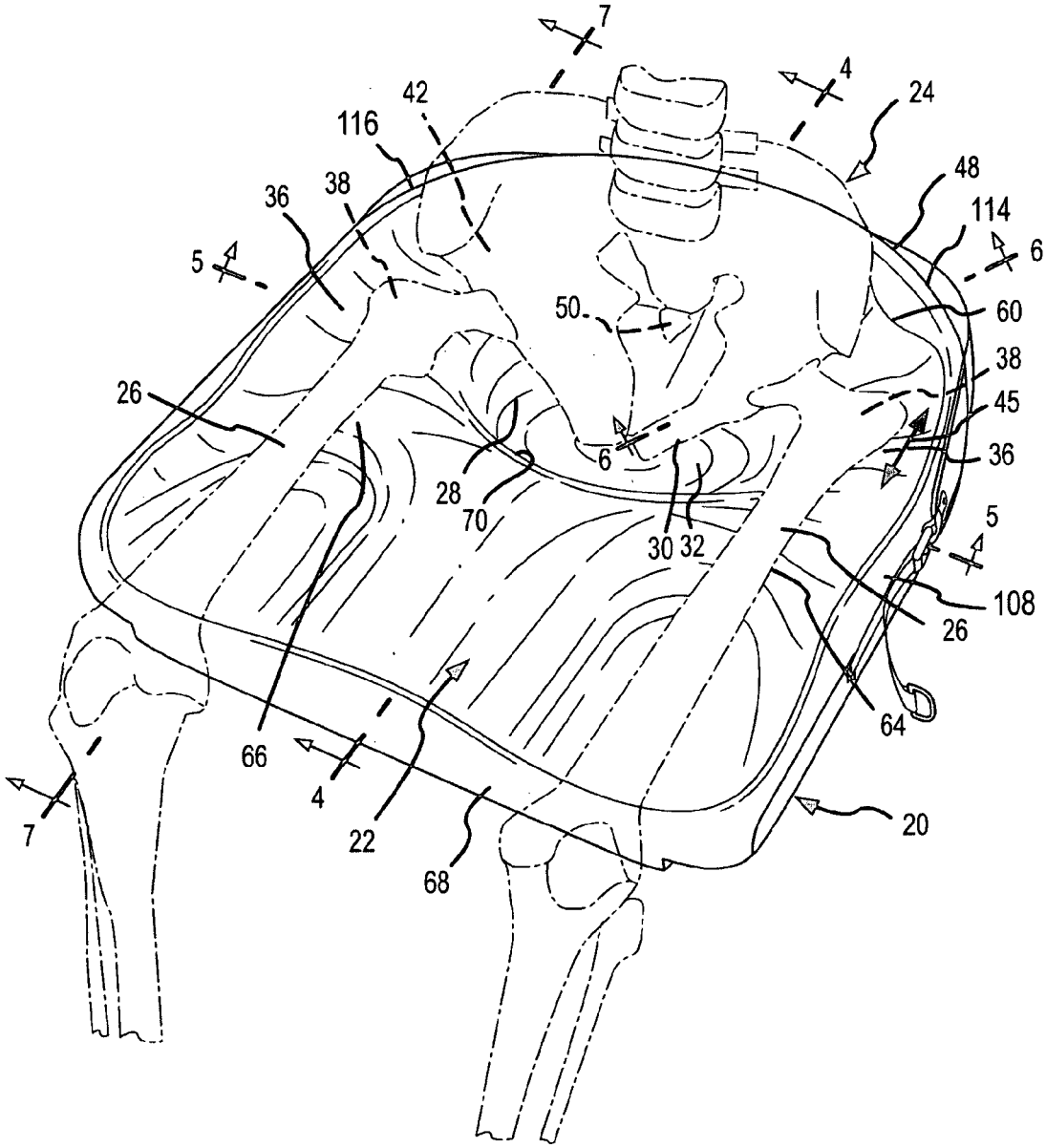
FIG. 3 is a perspective view of the seat cushion shown in FIG. 1, showing a typical human pelvic and thigh skeletal structure superimposed over a support contour of the seat cushion.

The support contour 22 rises from the lowermost surface area 32 on opposite transverse sides of the cavity 28 to a relief area 36, as shown in FIGS. 5 and 9. The relief area 36 is positioned directly below and transversely to the outside of the greater trochanters 38 on both transverse sides of the support contour 22, when the user is seated on the cushion 20, as shown in FIG. 3. The greater trochanters 38 are the parts of the leg thigh bone 26 which extend to the "ball" part of the "hip joint," as those terms are referred to in common language. The "socket" part of the "hip joint" is located within the "hip" or pelvic bone 42.

The horizontal and transversely outwardly and upwardly curved portions of the relief area 36 are configured to establish a vertical and transverse clearance 44 with respect to the greater trochanters 38, as shown in FIG. 5. The relief area 36 is also configured to provide a longitudinal range of clearance 45 relative to the greater trochanters 38, as understood from FIG. 3. The curvature and position of the relief area 36 is sufficient to offload pressure and shear force from the skin surrounding the greater trochanters 38. It is primarily the skin below and to the transverse outside of the greater trochanters 38 that is susceptible to pressure and shear force when the user is seated on the cushion. The relief area 36 establishes enough relief through the clearances 44 and 45 to offload the pressure and shear force from the skin surrounding greater trochanters 38 in these locations.

The clearances 44 and 45 are also sufficient to provide tolerance for slightly different seating positions of the user. This tolerance also accommodates movement of the greater trochanters 38 through a dynamic range of movement of the user.

Figure 8:
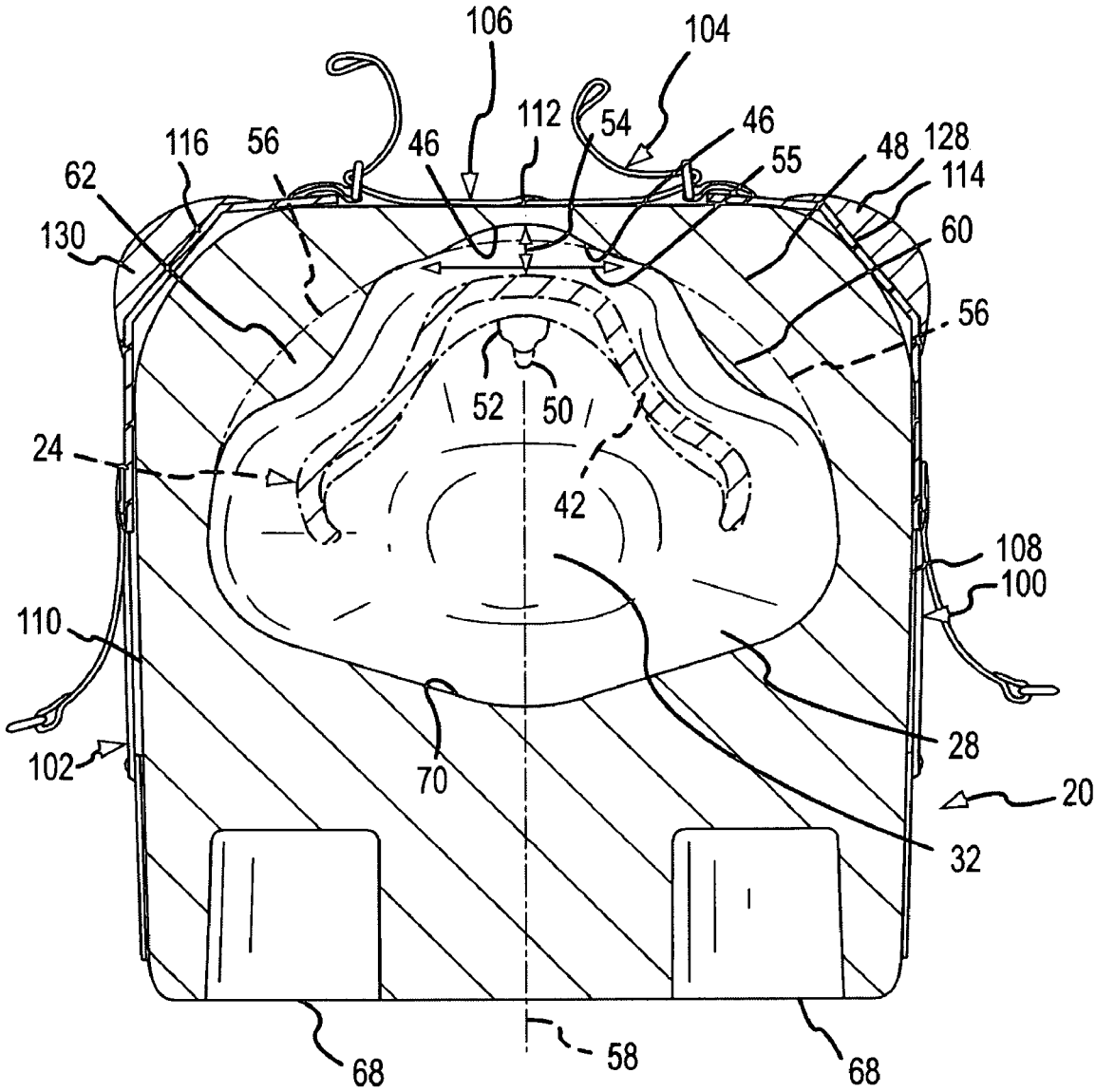
FIG. 8 is a transverse and substantially horizontal cross-sectional view taken substantially in the plane of line 8—8 of FIG. 4.

The support contour 22 also includes a recessed channel area 46 which extends vertically upward from the lowermost surface area 32 of the cavity 28 to an upper rear edge of the support contour 22, as shown in FIGS. 4, 8 and 9. The channel area 46 is located at approximately the transverse center of a rear wall 48. The rear wall 48 extends from one transverse side of the cavity 28 from a location generally adjacent to one greater trochanter relief area 36 around the rear of the cavity 28 to the other transverse side of the cavity 28 at a location generally adjacent to the other greater trochanter relief area 36, as shown in FIGS. 3, 4 and 8. The greater trochanter relief areas 36 generally curve vertically downward and transversely inward from the outer periphery of the back wall 48 at these opposite transverse positions of the support contour 22. As shown in FIG. 4, the rear wall 48 rises to an elevation at the rear of the cavity 28 which is sufficient to orient the pelvic area within the cavity 28 to resist rearward pivoting or rocking movement of the pelvic bones 42.

The channel area 46 is located on the rear wall 48 on opposite sides of a transverse midline through the cushion 20. The channel area 46 extends downwardly and longitudinally forward from the back wall 48 toward the lowermost surface area 32 of the cavity 28 at the transverse midline of the support contour 22. The channel area 46 is positioned in the support contour 22 to be located directly behind the coccyx 50 and the sacrum 52 of the pelvic skeletal structure 24, when the user is seated in the cushion 20. The coccyx 50 is typically referred to in common language as the "tailbone."

The channel area 46 is recessed into the rear wall 48 of the cavity 28 to a sufficient distance to establish a vertical and horizontal clearance 54 between the channel area 46 and the coccyx 50 and sacrum 52, as shown in FIG. 4. The channel area 46 also establishes a transverse clearance 55 which extends beyond each opposite lateral side of the coccyx 50 and sacrum 52, as shown in FIG. 8. A general midline contour of the rear wall 48 is illustrated by the dashed line 56 in FIG. 8. The dashed line 56 represents the exact anatomical shape of the rear pelvic area of a specific or generalized user. The amount of recess of the channel 46 into the rear wall 48 is illustrated by the offset of the channel area 46 behind the dashed line 56. The transverse extent of the channel area 46 is illustrated by its extent on opposite sides of a longitudinal centerline 58. Since the sacrum 52 generally tapers transversely inwardly toward the narrower coccyx 50, the channel area 46 may also have a slightly V-shaped curvature to generally parallel the downward and inward tapering of the sacrum 52 and coccyx 50.

The amount of the clearances 54 and 55 is sufficient to offload pressure and shear force from the skin surrounding the coccyx 50 and sacrum 52. Preferably, the clearances 54 and 55 are sufficient so that the skin surrounding the coccyx and sacrum does not even touch the channel area 46. The pressure and shear forces are offloaded under both static sitting conditions and under conditions of dynamic movement while in the seated position. By offloading the pressure and shear forces with the clearances 54 and 55, the risk of pressure ulcers on the skin surrounding the coccyx and sacrum is reduced substantially.

The lowermost surface area 32 of the cavity 28, the relief area 36, and the channel area 46 generally have the shape and position, relative to the anatomical shape of the user, to provide additional clearance in the support contour 22 in the location of those areas 32, 36 and 46 compared to the specific or a generalized anatomical shape. The additional clearance offloads pressure and shear forces from the skin surrounding the bony prominences of the ischial tuberosities 30, the greater trochanters 38, and the coccyx 50 and the sacrum 52. By offloading the pressure and shear forces from the skin surrounding these bony prominences, the risk of pressure ulcers is diminished.

To compensate for the increased clearance in the areas 32, 36 and 46, the support contour 22 provides greater protrusion for enhanced support in other areas 60, 62, 64 and 66 (FIG. 9) where there are relatively large and broad masses of tissue and muscle upon which the greater pressure can be applied without creating localized pressure points. The location of these greater or enhanced support areas is also established to encourage or orient the pelvic area 24 into a position which promotes postural alignment and control.

Figure 6:
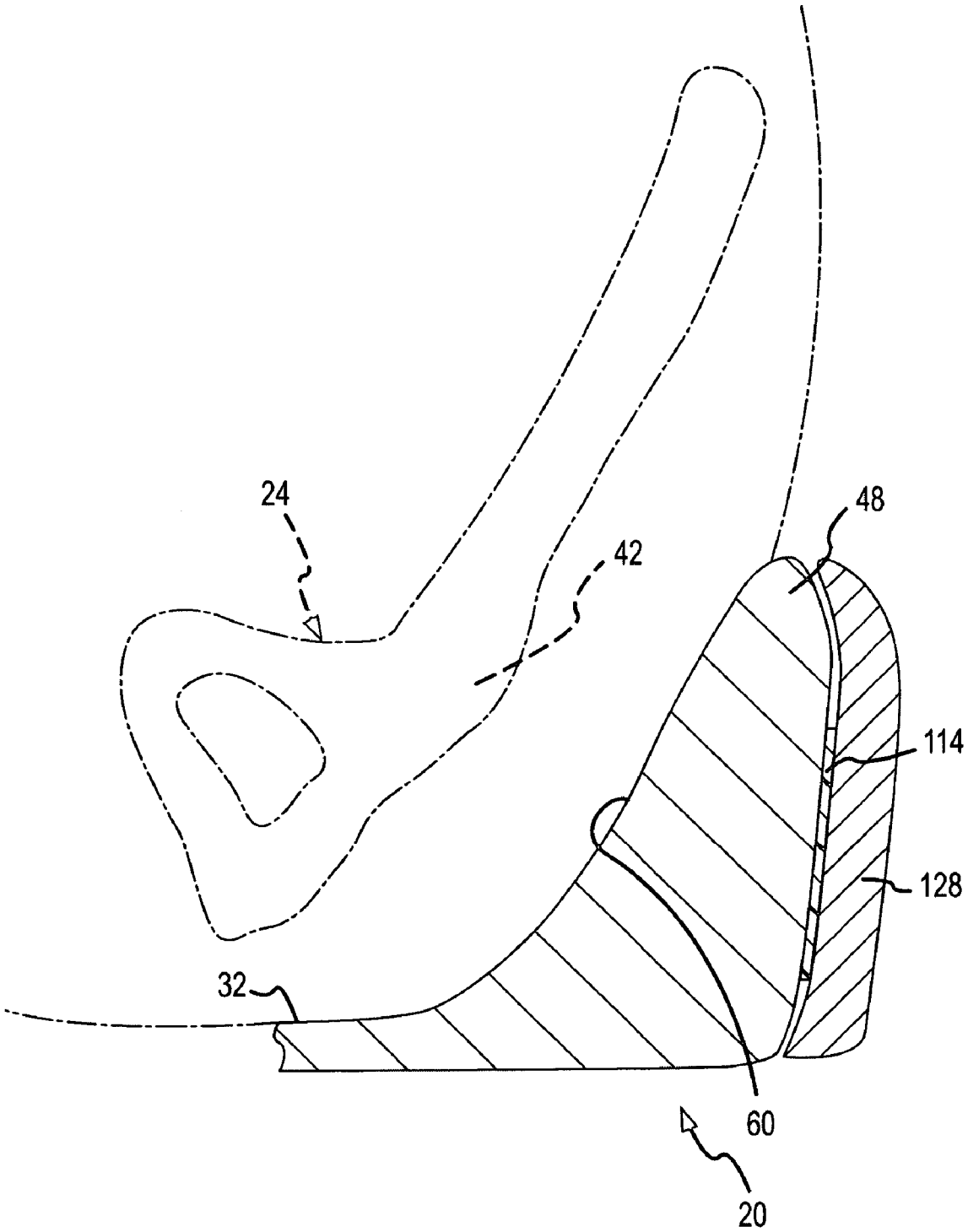
FIG. 6 is a vertical cross-sectional view of a portion of the support contour and skeletal structure shown in FIG. 3, taken substantially in the plane of line 6—6 of FIG. 3.

The support contour 22 includes two support areas 60 and 62 which are located on the back wall 48 of positions on opposite transverse sides of the longitudinal midline 58, as shown in FIGS. 6 and 8. The support areas 60 and 62 extend forwardly from the midline contour line 56, and therefore provide more protuberance to create exaggerated pressure and support on the tissue and musculature at the posterior lateral buttocks of the pelvic area which is contacted by the support areas 60 and 62. As shown in FIG. 6, the support area 60 (the support area 62 is similar, but not shown in FIG. 6) generally curves vertically downwardly and transversely and longitudinally forwardly from an upper position on the back wall 48 toward the lowermost surface area 32. The support areas 60 (and 62, not shown in FIG. 6) terminate vertically above the lowermost surface area 32. Oriented in this manner, the support areas 60 and 62 define forwardly and upwardly facing contact surfaces to contact the skin covering the tissue masses surrounding the pelvic bones 42 at the lateral posterior buttocks. The posterior lateral buttocks tissue and musculature are devoid of any underlying prominent bone structure. Instead, the considerable mass of posterior lateral buttocks tissue and musculature defines a relatively broad and substantial contact area which is able to accept and transfer the force into the pelvic skeletal structure which does not elevate the risk of developing pressure ulcers at those locations.

The enhanced support transferred into the lateral buttocks tissue and musculature from the support areas 60 and 62 biases or orients the pelvic area 42 in a slightly forward pivoted position (counterclockwise as shown in FIG. 4) which is the typical position for proper postural alignment. Without some encouragement to pivot the pelvic area 42 toward a position of proper postural alignment, some wheelchair users may tend to slouch or sink downwardly, thereby rotating the pelvic area 42 into an improper alignment (clockwise as shown in FIG. 4). The upward and forward support from the lateral buttocks support areas 60 and 62 encourages the user to maintain his or her pelvic area 24 in a proper postural alignment position.

The upward component of curvature from the support areas 60 and 62 (FIG. 6) tends to induce an upward lifting force on the posterior/lateral pelvic area, which assists in offloading the pressure from the relief areas 32, 36 and 46. The lateral buttocks support areas 60 and 62 also provide lateral stability which helps retain the user in contact with the support contour 22 of the seat cushion 20. The lateral support stability is applied from the opposite sides of the rear portion of the users body, and thus tends to inhibit the user from tipping backward or to the side within the cushion.

The relatively stiff corner support members 114 and 116 reinforce the rear wall 48, to resist unintended outward deflection of the relatively more flexible rear wall 48 resulting from the force of the users anatomy against the support areas 60 and 62. The support members 114 and 116 are also aided in reinforcing and supporting the rear wall 48 by the tension applied to the support members 114 and 116 from the adjustment straps 100, 102, 104 and 106. The tension force from the adjustment straps 100, 102, 104 and 106 is generally parallel to the sides 108, 110 and 112 of the cushion 20. The parallel side tension from the adjustment straps holds the support members 114 and 116 in the upright positions at the rear corners of the seat cushion, to thereby achieve an added level of reinforcement and support for the more vertically curved portions of the support contour 22.

Figure 7:
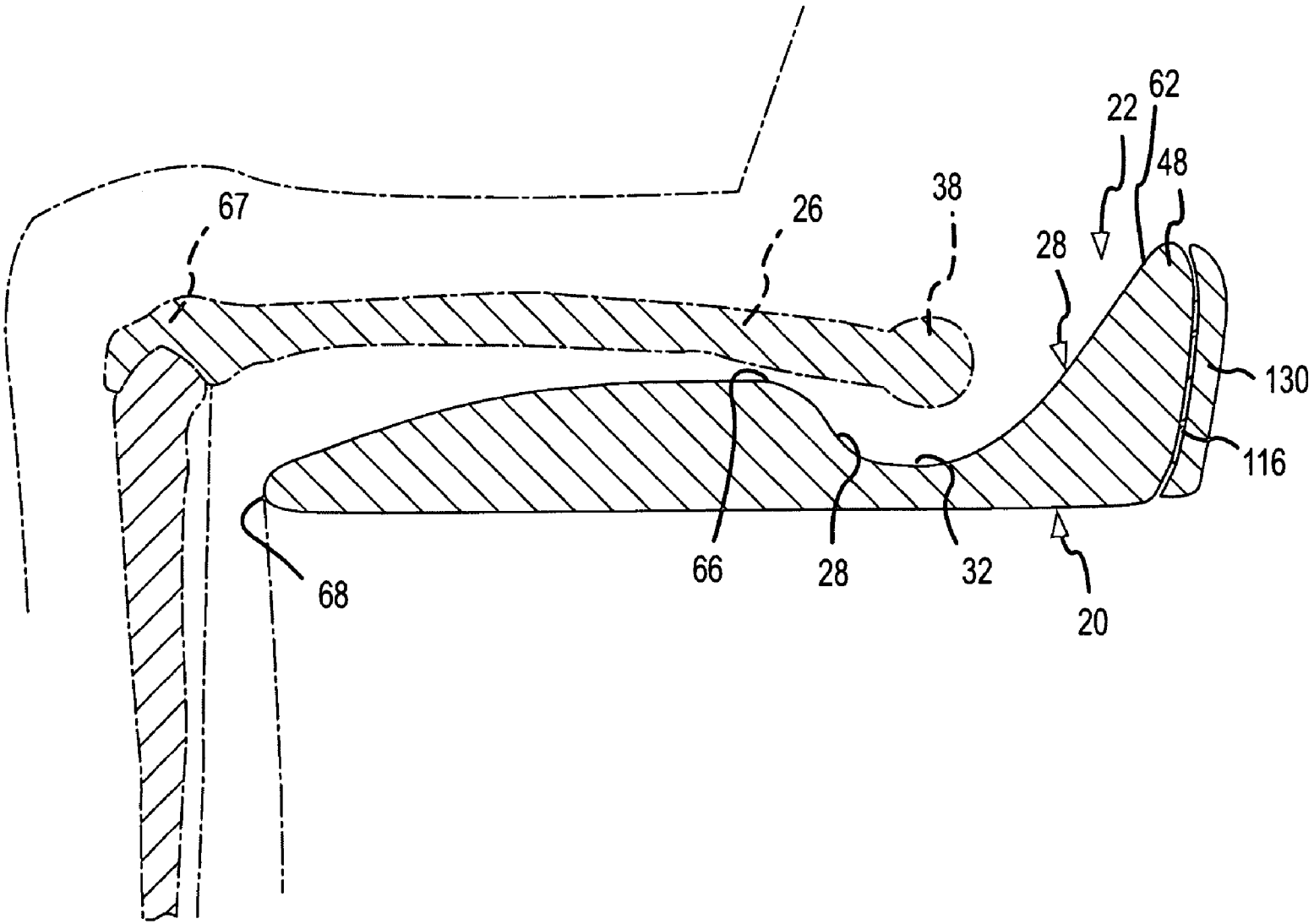
FIG. 7 is a longitudinal and vertical cross-sectional view taken substantially in the plane of line 7—7 of FIG. 3.

The support contour 22 also provides enhanced support from areas 64 and 66 which are located beneath the thigh bone 26 proximal to the greater trochanters 38, as shown in FIGS. 4, 7 and 9. The enhanced support areas 64 and 66 contact a relatively broad mass of tissue and muscle extending along the posterior thigh bone 26. The posterior thigh bone 26 extends generally longitudinally and has no prominences in the area where the support areas 64 and 66 contact the tissue surrounding the posterior thigh bones 26. The support areas 64 and 66 are able to transfer a relatively significant amount of pressure into the relatively broad mass of posterior thigh tissue and musculature to thereby support the skeletal structure.

As shown in FIGS. 4 and 7, the forward portion of the cavity 28 curves upward from the lowermost surface area 32 to the upper surface of the support areas 64 and 66. The extent of the upward curvature and the position of the support areas 64 and 66 is somewhat elevated above that position which would normally be defined by a general or specific anatomical structure. In general, the proximal thigh support areas 64 and 66 generally have the highest elevation at any location beneath the thigh bone 26. By elevating the support areas 64 and 66 slightly, a greater amount of support and pressure is applied on the proximal thigh bones.

Each of the support areas 64 and 66 is laterally displaced from the longitudinal midline 58, in order to be located beneath the thigh bones 26. In general, the support areas 64 and 66 generally extend transversely in a somewhat generally-horizontal shelf-like manner. In general, as shown from FIG. 7, the vertical heights of the support areas 64 and 66 are somewhat lower than the upper edges of the lateral buttocks support areas 60 and 62, because the tissue and musculature located beneath the proximal thigh bone 26 is located at a lower support position on the seated human anatomy than the lateral buttocks tissue and musculature.

The support areas 64 and 66 are located to interact with the thigh bones 26 at a position which is considerably closer to the location where the thigh bones 26 terminate at one end at the hip joints (not shown, but which are adjacent to the greater trochanters 38) compared to the locations at the opposite end of the thigh bones 26 where the thigh bones 26 terminate at knee joints 67, as understood from FIG. 7. Located in this manner, the support areas 64 and 66 act as a fulcrum for the thigh bones 26 for transferring the weight of the lower legs into the pelvic area 24. By locating the fulcrum-like protrusion of the support areas 64 and 66 relatively close to the pelvic area, the weight of the lower legs is transferred with a mechanical advantage into the pelvic area. The resulting weight transfer has the effect of naturally and inherently lifting the pelvic area. The lifting force on the pelvic area assists in separating the bony prominences from the relief areas of the support contour 22 and maintaining the clearances in those areas while simultaneously decreasing the pressure in those areas. The lifting force on the pelvic area 24 also tends to complement the upward force created by reaction with the enhanced support areas 60 and 62. The enhanced support, areas 60 and 62 also interact with the upward lifting force at the hips to prevent the pelvis from tipping backward in response to the lifting force. The lifting force transferred from the distal legs through the hip joints cooperates with the upward support force from the support areas 60 and 62 to encourage proper posture through upward alignment of the pelvic area at four stabilizing and counterbalancing locations at the hip joints and posterior lateral buttocks. The fulcrum-like mechanical advantage from the support areas 64 and 66 offers considerable benefit to wheelchair users who have diminished muscle capacity or control in the pelvic region.

The transfer of significant force into the posterior thigh tissue and musculature at the location of the support areas 64 and 66 complements the additional support from the areas 60 and 62 to maintain alignment for proper postural position of the pelvic area. The location of the support areas 60, 62, 64 and 66, as shown in FIG. 9, is at approximately the four transverse and longitudinal positions surrounding the pelvic structure to facilitate holding the pelvic structure into a position of proper postural alignment and to stabilize the user when seated on the support contour.

The support contour 22 slopes generally downward from each of the proximal thigh support areas 64 and 66, until it encounters a rounded front edge 68 of the cushion 20. The downward slope from the areas 64 and 66 to the front edge 68 of the cushion facilitates focusing the broad area of support on the tissue and musculature of the proximal thigh at the support areas 64 and 66, rather than to some other position closer to the knee joint 67 which might not provide the best support and weight transfer for proper postural position.

The portion of the support contour 22 which extends forward from the proximal thigh support areas 64 and 66 is somewhat downwardly oriented. This downward orientation helps maintain the thigh bones 26 in the forward extending manner within the seat cushion 20, to thereby assure that the tissue and musculature of the proximal thigh bone is located in contact with the support areas 64 and 66.

The support contour 22 also includes a clearance or relief area 70 which provides additional clearance in the perineal or genital area for the user sitting on the support contour 22. The additional clearance area 70 creates a space for relief of pressure and enhancement of air circulation where the skin is prone to breakdown from heat and moisture. Relieving the pressure and providing a space for air circulation in the area 70 is a substantial benefit to wheelchair and other users who must remain seated for long periods of time, by reducing the incidence of skin breakdown and sores in the perineal area.

The clearance area 70 generally curves upwardly and forwardly from the lowermost surface area 32 of the cavity 28 along the longitudinal midline, shown in FIG. 4. The upward and forward curvature at the longitudinal centerline is more gentle and extends farther forward than the more abrupt vertical and forward curvature of the cavity beneath the thigh bones 26, as understood by comparing FIGS. 4 and 7. Consequently, in a transverse sense, the area 70 extends slightly forwardly from the rear of the thigh support areas 64 and 66, as shown in FIGS. 3, 4, 7 and 9.

As is shown in FIG. 9, the areas 32, 36 and 46 are located to offload pressure and shear force from the skin surrounding the bony prominences of the pelvic area, i.e. the ischial tuberosities 30, the greater trochanters 38, and the coccyx 50 and sacrum 52. The pressure and shear force is offloaded by providing greater relief in the support contour 22 in the areas 32, 36 and 46. The greater relief is obtained by exaggerating the clearance of the support contour 22 in the areas 32, 36 and 46 compared to a contour which would generally complement the anatomical shape in those areas. The areas 60, 62, 64 and 66 provide enhanced support or exaggerated protrusion, to compensate for the clearance in the areas 32, 36 and 46, and to orient or bias the pelvic area into a position of proper postural alignment. The location of the enhanced support areas 60, 62, 64 and 66 is to contact relatively broad masses of tissue and musculature which are devoid of bony prominences. The relatively broad mass of tissue and musculature is able to withstand the increased pressure from the support areas 60, 62, 64 and 66 without substantially increasing the risk of pressure ulcers. The support transferred from the four support areas 60, 62, 64 and 66 is generally applied to the pelvic area skeletal structure 24 at four points at the front and back and opposite transverse positions, thereby providing the best lateral and longitudinal support for stability purposes.

By providing greater clearance in the area of the bony prominences and more support in the areas of broad tissue and muscle mass, the support contour 22 departs from an exact negative or complement of the shape of the user. However, to create the areas 32, 36 and 46 of enhanced clearance, and the areas 60, 62, 64 and 66 of enhanced support, it is necessary to obtain the shape of the specific user or a general class of users and then modify that shape to obtain the characteristics of the areas 32, 36, 46, 60, 62, 64 and 66. The above-referenced U.S. patent application Ser. No. 10/628,858 describes an advantageous technique for obtaining the anatomical shape of a wheelchair user and forming the cushion 20.

By offloading pressure from the bony prominence areas 32, 36 and 46, and by applying the exaggerated support in the broad tissue and musculature areas 60, 62, 64 and 66, atrophy changes are less likely to have a significant negative impact. In general, the added clearance in the areas of the bony prominences provides an additional tolerance for tissue atrophy.

The increased clearance from the areas 32, 36 and 46, and the increased prominence of the support areas 60, 62, 64 and 66 also makes the support contour 22 more generally applicable to classes of individual users. By adjusting the extent of clearances and prominences of the areas 32, 36, 46, 60, 62, 64 and 66 it is possible to accommodate standard classes of individual users. For example, one standard variation of the support contour 22 may primarily accommodate the wider spread and shallower slope of the ischial tuberosities of the female skeletal bone structure. Another standard variation of the support contour 22 may accommodate the narrower and steeper slope of the ischial tuberosities of the male skeletal bone structure. Another standard variation of the support contour 22 is not gender-specific, but has a deeper and steeper profile. This deeper and steeper support contour 22 may provide better protection for individuals with soft tissue atrophy. However regardless of sex or degree of tissue atrophy, any user may prefer any one of these different standard variations of support contours, depending on personal comfort, support and preference. The benefits of the support contour 22 thereby extend to a substantial population of wheelchair users without requiring that population to obtain a custom wheelchair cushion. This benefit is more specifically described in the above-referenced U.S. patent application Ser. No. 10/628,859.

Figure 13:
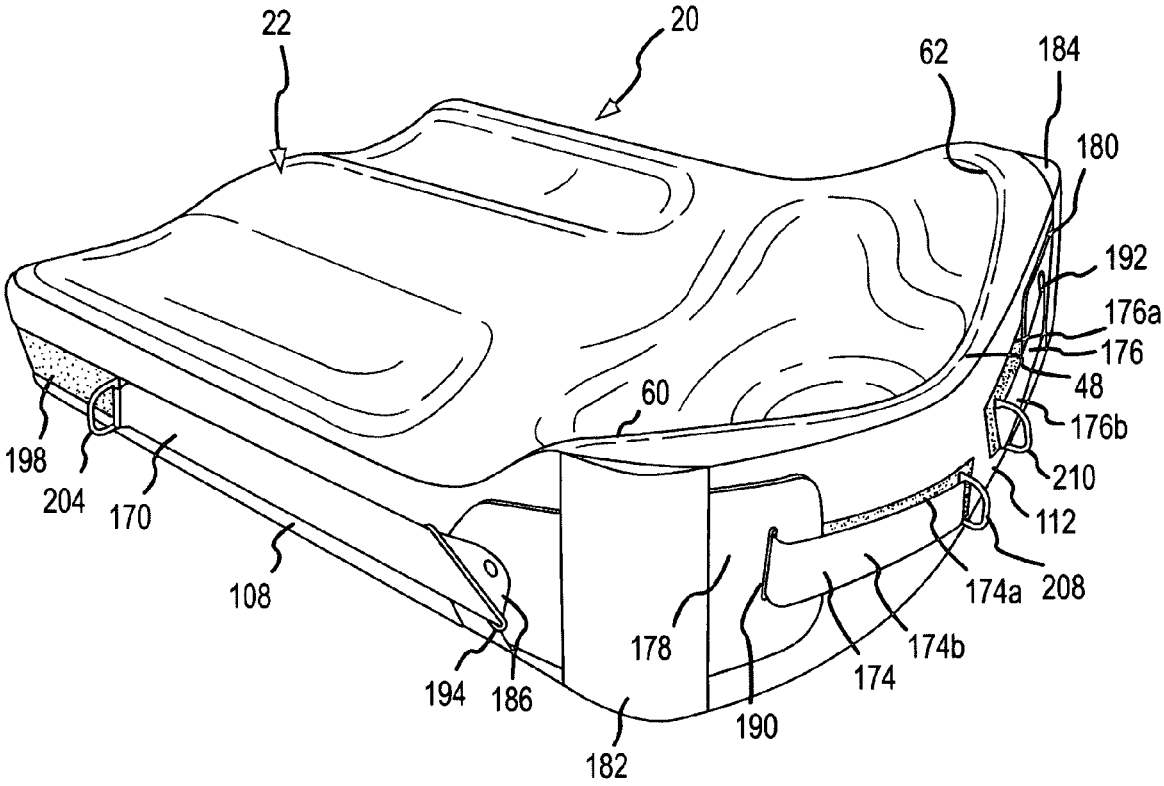
FIG. 13 is a perspective view of another contoured wheelchair or other seat cushion which also incorporates the present invention.
Figure 14:
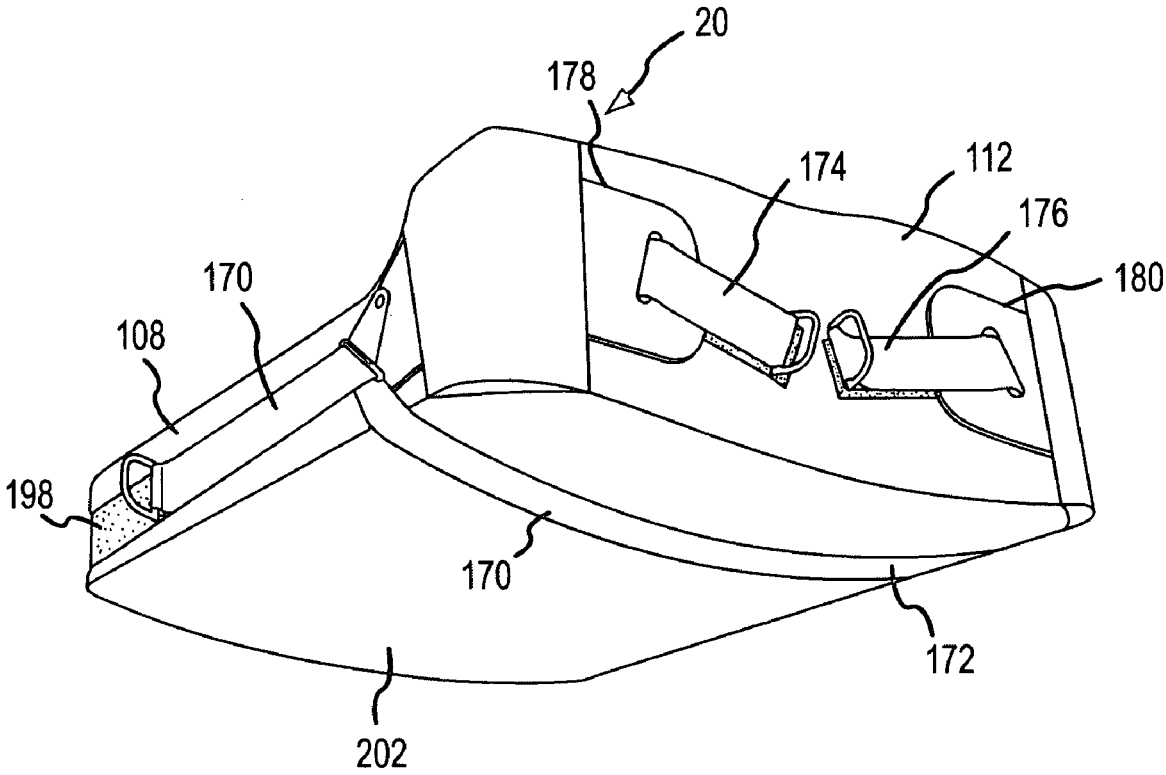
FIG. 14 is a different perspective view of the contoured seat cushion shown in FIG. 13.
Figure 15:
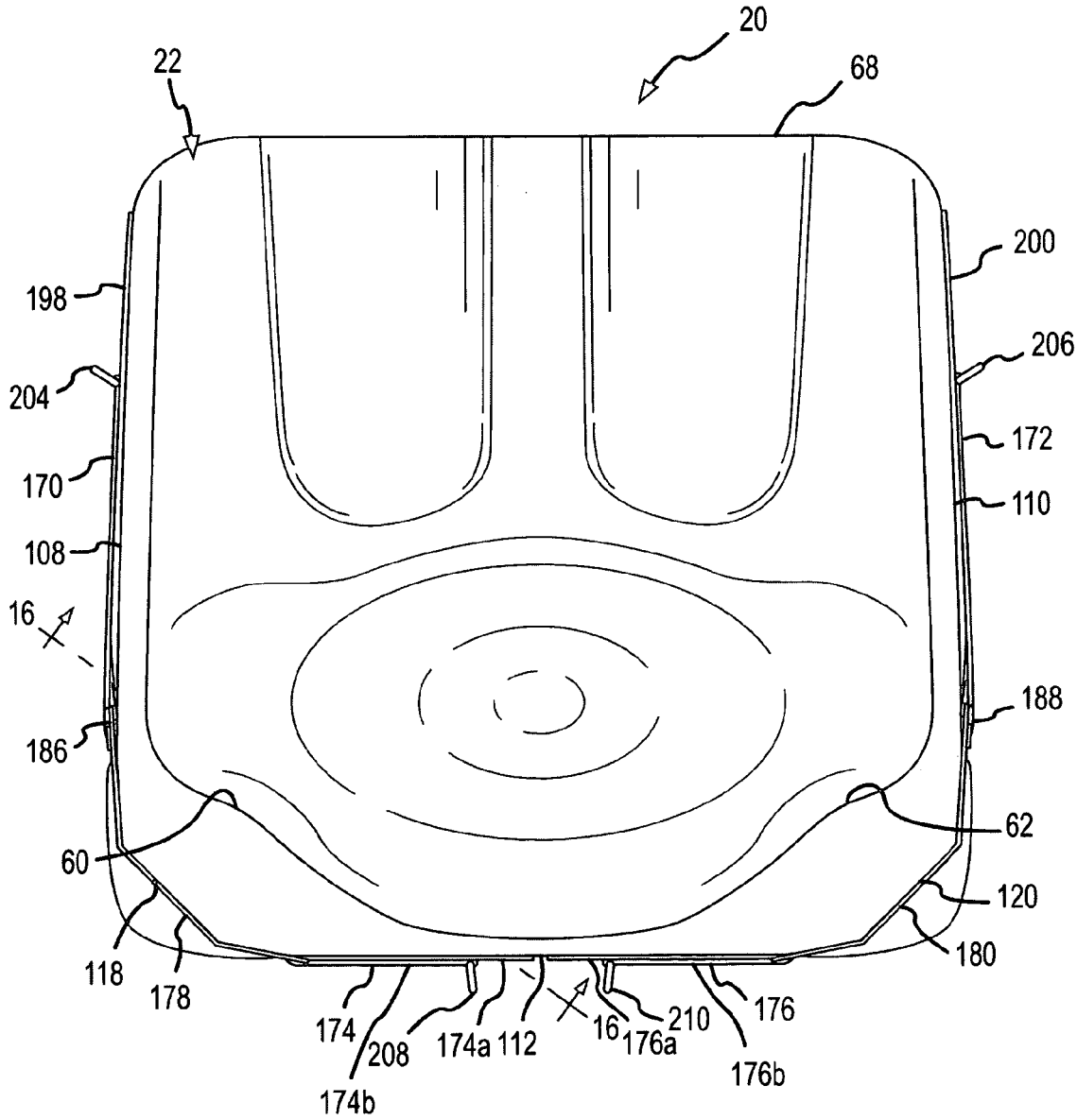
FIG. 15 is a top plan view of the seat cushion shown in FIG. 13.
Figure 16:
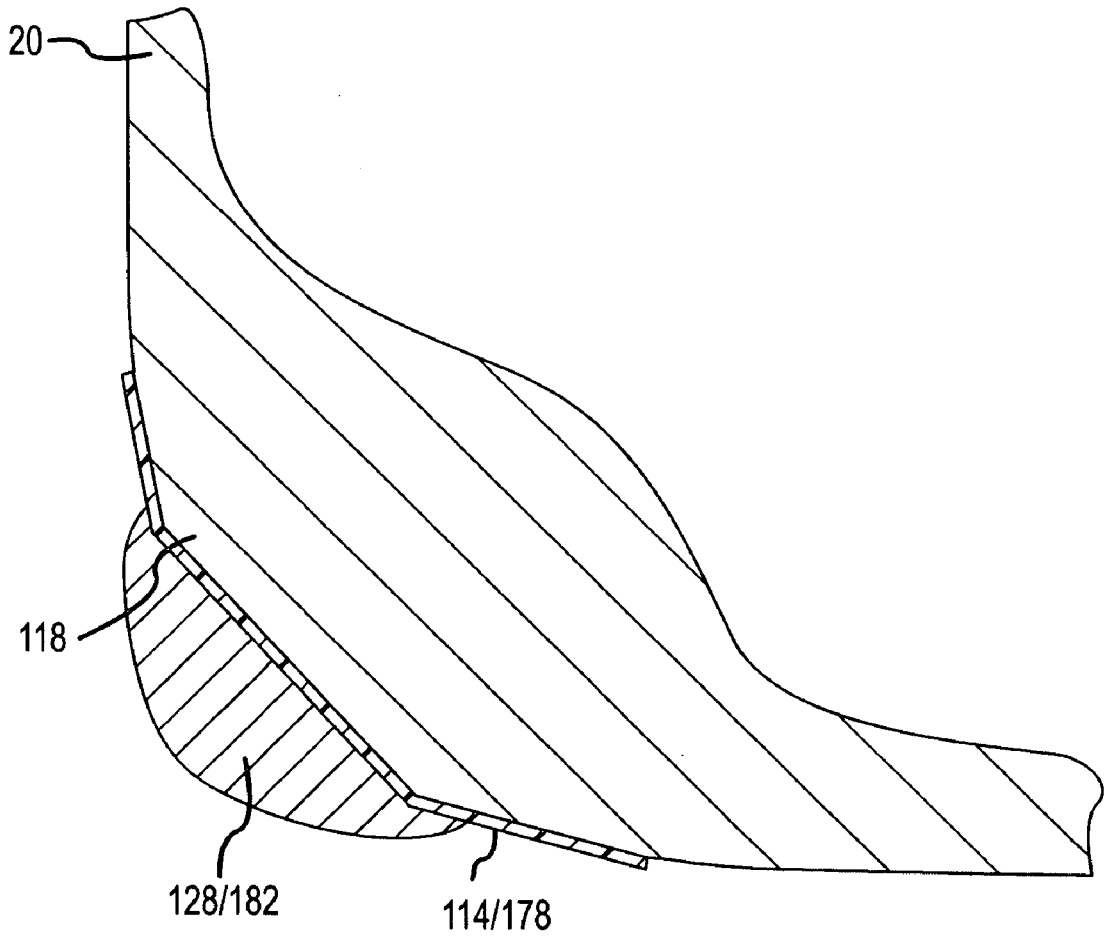
FIG. 16 is an enlarged horizontally sectioned view of a portion of FIG. 15, showing an adjustment and reinforcing structure and mechanism of the seat cushion.

Details of a technique for reinforcing and adjusting the support contour 22 are described in conjunction with FIGS. 1, 2 and 10–24. The reinforcing and adjustment capabilities are achieved by use of the straps 100, 102, 104 and 106, which interact with the corner support members 114 and 116, as has been generally described above in conjunction with FIGS. 1 and 2 and which will be described in greater detail below in conjunction with FIGS. 1, 2 and 10–12. The reinforcing and adjustment capabilities are also achieved by another arrangement of straps 170, 172, 174 and 176, which interact with corner support members 178 and 180, as described below in conjunction with FIGS. 13–24. The effect of the adjustment of both arrangements of straps and corner support members, shown in FIGS. 1, 2, 10, 11 and 12 and in FIGS. 13–15 are shown in FIGS. 16–24.

Figure 11:
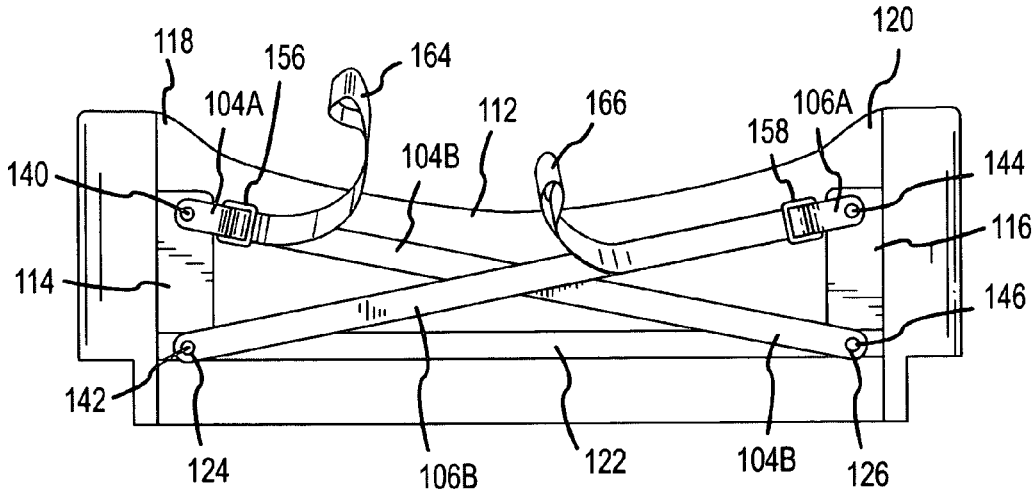
FIG. 11 is a rear elevation view of the seat cushion shown in FIG. 1.
Figure 12:
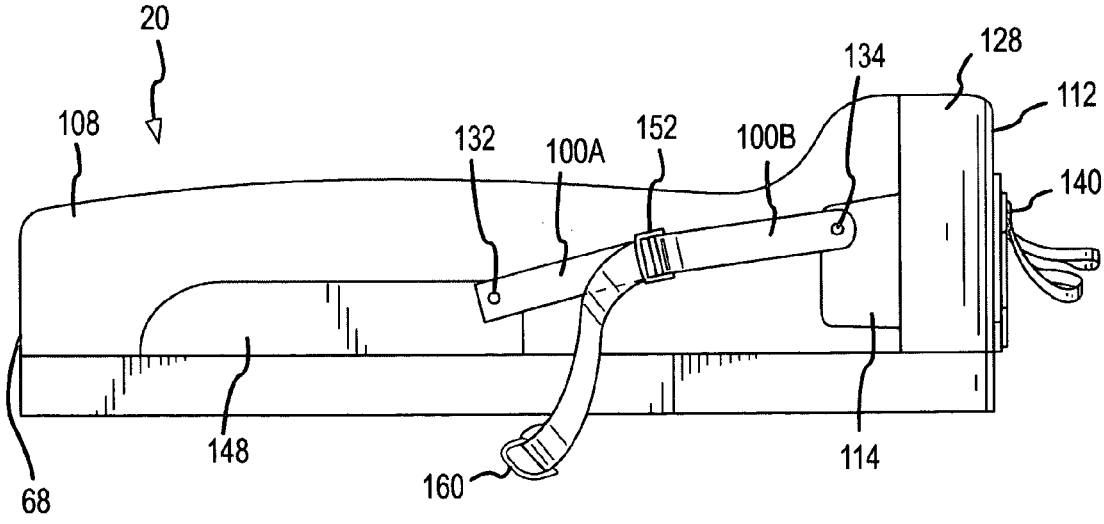
FIG. 12 is a side elevation view of the seat cushion shown in FIG. 1.

In the reinforcing and support arrangement shown in FIGS. 1, 2 and 10–12, the corner support members 114 and 116 provide support for the opposite rear corners 118 and 120 of the cushion 20 by their engagement with the seat cushion 20 at the left (as shown, FIG. 10) rear corner 118 and the right (as shown, FIG. 10) rear corner 120, respectively. The support members 114, 116 and the transverse brace 122 are formed from a material that is more rigid than the resilient plastic foam material from which the seat cushion 20 is formed. The support member 114 extends from the longitudinal extending side 108 of the cushion 20 around the left rear corner 118 to the rear transverse extending side 112 of the cushion 20. The support member 116 extends from the longitudinal extending side 110 of the corner around the right rear corner 120 to the rear transverse extending side 112 of the corner. The transverse brace 122 extends from the support member 114 to the support member 116. The transverse brace 122 connects to the support member 114 at a pivot joint 124 and connects to the support member 116 at a pivot joint 126, as shown in FIG. 11. The pivot joints 124 and 126 are located at lower transversely-facing edges of the support members 114 and 116, respectively. The support members 114 and 116 pivot transversely toward one another in an arc with respect to pivot joints 124 and 126 due to the relative rigidity of the transverse brace 122. The support members 114 and 116 are also able to pivot longitudinally due to slight twisting of the transverse brace 122. The support member 114 is attached to the cushion and is held in place at the left rear corner 118 with the longitudinal strap 100 and the transverse strap 104. The support member 116 is attached to the cushion and held in place at the right rear corner 120 with the longitudinal strap 102 and the transverse strap 106. Corner padding parts 128 and 130, preferably formed from the same material as the seat cushion 20, cover the exterior outside surfaces of the support members 114 and 116, respectively.

The support members 114 and 116 provide additional structural support and reinforcement for the rear wall 48 of the seat cushion 20 at the corners 118 and 120, respectively, to retain and help maintain the shape of the support contour 22 along the back wall 48 and of the portions adjacent the corners 118 and 120 when a user is seated on the cushion 20. The support members 114 and 116 are particularly helpful in resisting the deflection of the rear wall 48 outward away from the user under the influence of the users body contacting the support areas 60 and 62. The relative rigidity of the support members 114 and 116 provides this reinforcement. The relatively taut retention of the support members 114 and 116 against the rear corners 118 and 120 by the straps 100, 102, 104 and 106, holds the support members so that they reinforce and support the portions of the seat cushion 20 at the corners 118 and 120.

The straps 100, 102, 104 and 106 are connected to the support members 114 and 116 by the use of strap holders 132, 134, 136, 138, 140, 142, 144 and 146. The strap holders shown in FIGS. 1, 2, 11 and 12 are rivet type fasteners but other conventional fasteners will also work so long as the fastener securely holds the strap 100, 102, 104 and 106 in place.

The other ends of the straps 100 and 102, i.e. those ends which are not connected to the support members 114 and 116, are connected to the cushion 20 with base plates 148 and 150. The base plates 148 and 150 are adhesively attached to the longitudinally sides 108 and 110 of the cushion 20, respectively, but the base plates 148 and 150 can also be molded within or integrally formed with the resilient plastic foam material of the cushion 20. The base plates 148 and 150 are preferably made from a material that is relatively more rigid than the resilient plastic foam material of the seat cushion 20.

The straps 100, 102, 104 and 106 have opposite end portions. The strap 100 has a forward end portion 100A and a rearward end portion 100B (FIG. 12), while strap 102 has a forward end portion 102A and a rearward end portion 102B. The forward end portions 100A and 102A extend along the longitudinal extending sides 108 and 110 and are connected to the base plates 148 and 150 using strap holders 132 and 136. The rearward end portions 100B and 102B of the straps 100 and 102 are connected to the support members 114 and 116 using strap holders 134 and 138, respectively. The straps 100 and 102 extend along and generally parallel to the longitudinal extending sides 108 and 110, respectively. The forward end portion 100A and the rearward end portion 100B are connected together with a fastener or buckle 152. As shown in FIG. 12 the buckle 152 is attached at a fixed location on the rearward end portion 100B, while the forward end portion 100A loops through the buckle 152 to secure the end portion 100A to the buckle 152. The forward end portion 102A and rearward end portion 102B are connected together with a buckle 154. The buckle 154 is attached at a fixed location on the rearward end portion 102B, while the forward end portion 102A loops through the buckle 154 to secure the end portion 102A to the buckle 154, in essentially the same manner that the buckle 152 attaches the end portions 100A and 100B to the strap 100.

The transverse strap 104 has opposite left and right end portions 104A and 104B, respectively, while transverse strap 106 has opposite right and left end portions 106A and 106B, respectively, as shown in FIG. 11. The left end portion 104A and right end portion 106A attach to the support members 114 and 116, respectively. The right end portion 104B and left end portion 106B attach to the support members 116 and 114, respectively. Connected in this way, the transverse straps 104 and 106 cross on the rear transverse extending side 112 of the cushion 20. In extending from support member 114 to the support member 116, the strap 104 angles from a relatively higher vertical position at the point where the strap holder 140 attaches the strap 104 to support member 114 to a relatively lower vertical position at the point where the strap holder 146 attaches the strap 104 to the support member 116. In extending from the support member 116 to the support member 114, the strap 106 angles from a relatively higher vertical position where the strap holder 144 attaches the strap 106 to the support member 116 to a relatively lower vertical position where the strap holder 146 attaches the strap 106 to the support member 114.

As shown in FIG. 11 the right end portion 104B is attached to the support member 116 at the pivot joint 126 using the strap holder 146, and the left end portion 106B is attached to the support member 114 at the pivot joint 124 using the strap holder 142. The strap holders 142 and 146 are used to attach the straps 106 and 104 to the support members 114 and 116, and as shown in FIG. 11, are also used to pivotally attach the support members 114 and 116 to opposite ends of the transverse brace 122. The strap holders 142 and 146 can also be connected at points independent of the pivot joints 124 and 126.

The left end portion 104A and the right end portion 104B are connected together with a buckle 156, and the right end portion 106A and the left end portion 106B are connected together with a buckle 158. As shown in FIG. 11, the buckles 156 and 158 are attached at fixed locations on the strap end portions 104A and 106A and the strap end portions 104B and 106B attach by looping through the buckles 156 and 158. All of the buckles 152, 154, 156, and 158 are a conventional type of buckle for fastening straps together, and can be made from a strong plastic or other material.

Adjustment of the support contour 22 is achieved by deforming the rear wall 48 of the cushion 20 in the area adjacent to the support members 114 and 116. Deformation is achieved by bias force applied through the straps 100, 102, 104 and 106 to pivot and to move the support members 114 and 116 independently of one another longitudinally forward, transversely inward or in both directions. Connecting the straps 100, 102, 104 and 106 in the manner described allows adjusting the functional length of the straps 100, 102, 104 and 106 relative to the support members 114 and 116 by adjusting the length of the strap end portions 100B, 102B, 104B and 106B looped through the buckles 152, 154, 156 and 158.

Each of the strap end portions 100B, 102B, 104B and 106B have a taut segment between the buckles 152, 154, 156 and 158 and the support members 114 and 116 to which they are attached. Each of the strap end portions 100B, 102B, 104B and 106B also have a loose segment which extends beyond the buckles 152, 154, 156 and 158 from the taut segment. By pulling the loose segment of the strap end portions 100B, 102B, 104B and 106B, the lengths of the taut segments are shortened as more of the strap end portions 100B, 102B, 104B and 106B move from the taut segment on one side of the buckles 152, 154, 156 and 158 to the loose segment on the other side of the buckles. In this way the overall functional length of the straps 100, 102, 104 and 106 is shortened. Increasing the overall functional length of the straps 100, 102, 104 and 106 is accomplished by lengthening the amount of the taut segment of the strap end portions 100B, 102B, 104B and 106B and shortening the amount of the loose segment of the strap end portions 100B, 102B, 104B and 106B.

The loose segments of the strap end portions 100B, 102B, 104B and 106B have pull loops 160, 162, 164 and 166 attached at the terminal ends of the loose segments to facilitate pulling the strap end portions 100B, 102B, 104B and 106B, respectively, to adjust the functional length of the straps 100, 102, 104 and 106. The pull loops 160 and 162 are rigid, are preferably formed from a strong plastic material, and are attached to the terminal ends of the strap end portions 100B or 102B by looping an end part of the strap through the pull handle 160 or 162 and attaching the end part of the strap back to the strap end portion. The pull loops 164 and 166 that are connected to the loose segments of the strap end portions 104B and 106B are made from making a loop in the strap end portion 104B and 106B and sewing the strap end portions 104B and 106B back to themselves. Each of the pull loops 160, 162, 164 and 166 facilitates the adjustment of the straps by providing a convenient finger hold to manipulate the loose end portions of the straps 100, 102, 104 and 106.

Deformation of the rear wall 48 to adjust the support contour 22 is realized by bias force applied through the taut segments of the end portions of the straps 100, 102, 104 and/or 106 on the support members 114 and 116. Connecting the straps in the manner described allows the taut segment length of the straps to be adjusted to move the support members 114 and 116. Adjustment of the support members 114 and 116 in a longitudinal forward direction along the longitudinal sides 108 and 110 is achieved by gripping the pull loops 160 and 162 and pulling the loose segments of the end portions 100B and 102B toward the front edge 68 of the cushion 20. Adjustment of the support members 114 and 116 in the transverse inward direction is achieved by gripping the pull loops 164 and 166 and pulling the loose segments of the end portions 104B and 106B generally toward the opposite support member 116 and 114, respectively. This pulling movement shortens the taut segments of the straps 100B, 102B, 104B and 106B which moves the strap through the associated buckle toward the loose portion and thereby decreasing the length of the taut portion. When the desired length has been achieved, the pull loop is released and the associated buckle 152, 154, 156 and/or 158 retains the strap in position by preventing the loose segment of the strap end portion from moving back through the buckle. In this manner, the bias force applied through the straps pivots the support members 114 and 116 to slightly deform the rear wall 48 of the cushion 20 surrounding the support members 114 and 116, and thereby changes the shape of the support contour 22 in the area adjacent to the support members 114 and 116.

By releasing the tension on the taut segments of the straps 100, 102, 104 and 106, the resiliency of the seat cushion 20 causes the support contour 22 to regain its initial undeformed shape. Releasing the tension on the taut portions of the straps 100, 102, 104 and 106 is accomplished by pivoting the buckle 152, 154, 156 and/or 158 in a conventional way which releases the grip of the buckle on the strap 100, 102, 104 and/or 106, respectively.

Another technique for reinforcing and adjusting the support contour 22 is achieved by another arrangement of straps 170, 172, 174 and 176, which interact with corner support members 178 and 180, as described below in conjunction with FIGS. 13–15. The corner support members 178 and 180 provide support and reinforcement for the opposite rear corners 118 and 120 of the seat cushion 20 by their engagement with the left rear corner 118 and right rear corner 120, as shown in FIGS. 13 and 14. The support members 178 and 180 are formed from a material that is more rigid than the resilient plastic foam material from which the seat cushion 20 is formed. The support member 178 extends from the longitudinal extending side 108 around the left rear corner 118 to the rear transverse extending side 112. The support member 180 extends from the longitudinal extending side 110 around the right rear corner 120 to the rear transverse extending side 112. The support member 178 is attached to the cushion 20 and held in place at the left rear corner 118 with a longitudinal strap 170 and a transverse strap 174. The support member 180 is attached to the cushion 20 and held in place at the right rear corner 120 with a longitudinal strap 172 and a transverse strap 176. Corner padding parts 182 and 184 cover the outside surfaces of the support members 178 and 180, respectively.

Figure 2:
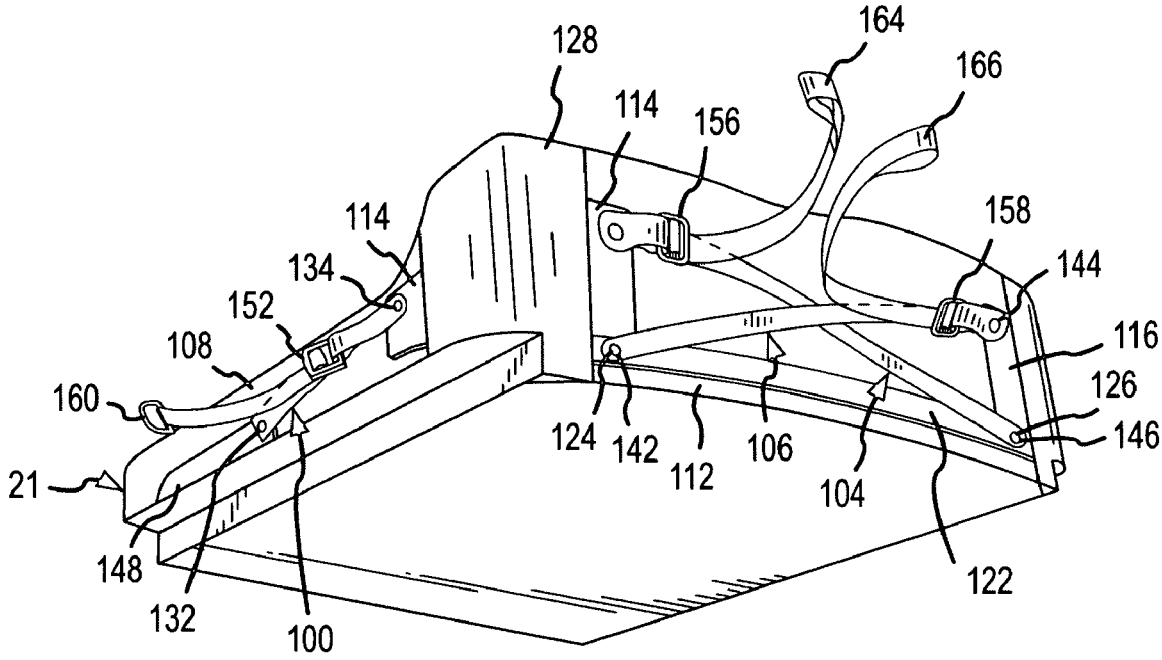
FIG. 2 is a different perspective view of the contoured seat cushion shown in FIG. 1.

The support members 178 and 180 and the connected straps 170, 172, 174 and 176 create structural support and reinforcement for the rear wall 48 in a way similar to that described above with respect to support members 114 and 116 and connected straps 100, 102, 104 and 106 (FIGS. 1–2). The support members 178 and 180 are held against the rear corners 118 and 120 by tension from taut segments of the straps 170, 172, 174 and 176, and this tension combined with the relative rigidity of the support members 114 and 116 reinforce the relatively more flexible material of the seat cushion 20 in the areas adjacent to the corners 118 and 120.

The straps 170 and 172, are connected to the support members 178 and 180 by slot connectors 186 and 188, and the straps 174 and 176 are connected to the support members 178 and 180 by threading the straps 174 and 176 through slots 190 and 192 formed in the support members 178 and 180, respectively. The slotted connectors 186 and 188 are pivotally attached to the support members 178 and 180 at positions which face generally parallel along the longitudinal sides 108 and 110 of the cushion 20, respectively. Slots 194 and 196 are formed in the slotted connectors 186 and 188, respectively. The longitudinal straps 170 and 172 extend through the slots 194 and 196, respectively. The slots 190 and 192 are formed in the support members 178 and 180, respectively, at positions which face one another across the rear transverse side 112 of the cushion 20. The transverse straps 174 and 176 loop through the slots 190 and 192 to connect the straps 174 and 176 to the support members 178 and 180.

The longitudinal straps 170 and 172 are connected to the cushion 20 by attachment strips 198 and, 200 which are adhesively secured along the longitudinally extending sides 108 and 110 of the cushion, as shown in FIG. 13. The attachment strips 198 and 200 are located beneath the end portions of the straps 170 and 172, respectively. The outward facing surfaces of the attachment strips 198 and 200 include a plurality of either conventional loops or hooks which interact with and are connected to the other type of conventional hooks or loops that are attached to the inward facing surfaces of the free forward ends of the longitudinal straps 170 and 172. The mating hooks and the loops on the end portions of the straps 170 and 172 and on the attachment strips 198 and 200 form a conventional hook and loop fastener. When the hooks and the loops on the interfacing surfaces of the forward end portions of the longitudinal straps 170 and 172 and the attachment strips 198 and 200 are brought together, forward end portions of the straps 170 and 172 are firmly retained to the cushion 20 at a fixed position.

The straps 170 and 172 are parts of a single strap. This single strap begins at one free end portion of one of the straps 170 or 172 and extends longitudinally rearwardly through one of the slots 194 or 196 of one of the slotted connectors 186 or 188 and turns downwardly to extend across a bottom surface 202 of the cushion 20, as shown in FIG. 14. The single strap then extends upwardly through the other one of the slots 194 or 196 of the other slotted connectors 186 or 188 and turns forwardly to become the other free end portion of the other strap 170 or 172. In this manner, the longitudinal straps 170 and 172 form a continuous strap. The portion of the single continuous strap 170 and 172 that is adjacent to the bottom surface 202 of the cushion 20 can be connected to the bottom surface 202 or can be left free to move slightly with respect to the bottom surface 202. The extension of the straps 170 and 172 through the slots 194 and 196 of the slotted connectors 186 and 188, and the extension of the continuous portion of the two straps 170 and 172 across the bottom surface 202 of the cushion 20 also assists in connecting the straps 170 and 172 to the cushion. The slotted connectors 186 and 188 pivot to allow the straps 170 and 172 to change direction from longitudinally along the sides 108 and 110 to downward where the straps 170 and 172 transition to the bottom surface 202, in accordance with the force applied along the lengths of the portions of the straps 170 and 172.

The transverse straps 174 and 176 are connected to the transverse rear side 112 of the cushion 20. Inward facing surfaces of end portions 174*a* and 176*a* of the straps 174 and 176, respectively, are adhesively attached to the transverse rear side 112 of the cushion. The end portions 174*a* and 176*a* are therefore permanently connected to the cushion 20. The other opposite end portions 174*b* and 176*b* of the straps 174 and 176 extend through the slots 190 and 192 formed in the support members 178 and 180, respectively, and these free end portions 174*b* and 176*b* then loop back over on top of the connected end portions 174*a* and 176*a*. Slot connectors, similar to slot connectors 186 and 188, can be utilized in place of the slots 190 and 192. The outward facing surfaces of the connected end portions 174*a* and 176*a* include a plurality of either loops or hooks which interact with and are connected to the other type of hooks or loops that are attached to the inward facing surfaces of the free end portions 174*b* and 176*b*. The hooks and the loops on the free end portions of the straps 174 and 176 form a conventional hook and loop fastener. When the hooks and the loops on the interfacing surfaces of the end portions of the straps 174 and 176 are brought together, the ends of the straps 170 and 172 are firmly retained to the cushion 20. The slots 190 and 192 formed in the support members 178 and 180 also connect the straps 174 and 176 to the cushion.

The straps 170, 172, 174 and 176 are preferably made from a strong flexible material such as nylon. The portions of the conventional hook and loop fasteners are attached to the end portions of the straps 170, 172, 174 and 176 by sewing or by an adhesive.

Adjustment of the support contour 22 is achieved by deforming the rear wall 48 of the cushion 20 in the area adjacent to the support members 178 and 180. Deformation is achieved by bias force applied through the straps 170, 172, 174 and 176 to pivot and to move the support members 178 and 180 independently of one another longitudinally forward, transversely inward or in both directions. Connecting the straps 170, 172, 174 and 176 in the manner described allows adjusting the length of taut segments of the straps 170, 172, 174 and 176 relative to the support members 178 and 180 by adjusting the positions of the free end portions of the straps 170 and 172 relative to the attachment strips 198 and 200, respectively, and by adjusting the position of the free end portions 174*b* and 176*b* relative to the connected end portions 174*a* and 176*a* of the straps 174 and 176.

The adjustment is achieved by gripping pull loops 204, 206, 208 and/or 210, and separating the free end portions of the straps attached to the pull loops from the corresponding cushion-connected parts of the conventional hook and loop fasteners, readjusting the relative position at which the straps extend through the slots in the support members 178 and 180, and then reattaching the free end portions of the straps back to the corresponding portion of the conventional hook and loop fasteners to hold the new adjusted position of the support members 178 and 180. In this manner, the length of taut segments of the straps is adjusted and bias force is applied through the taut segments of the straps to the support members 178 and 180 to slightly deform the rear wall 48 of the cushion 20 surrounding the support members 178 and 180, and thereby slightly changing the shape of the support contour 22.

The corner support members 114, 116, 178 and 180 are movable independently of one another within the limits allowed by the resiliency of the resilient plastic foam material forming the seat cushion 20. Inward movement by the corner support members 114, 116, 178 and 180 causes the resilient material of the seat cushion 20 to be compressed in areas where the material is thinner and moved to a lesser degree where the material is relatively thicker. In this way, movement of the support members 114, 116, 178 and 180 causes changes in the shape of the support contour 22 of the seat cushion 20. Examples of the types of adjustment available by use of the straps 100, 102, 104 and 106 and corner supports 114 and 116, and by use of the straps 170, 172, 174 and 176 and support corners 178 and 180, are shown in FIGS. 16–24.

Figure 17:
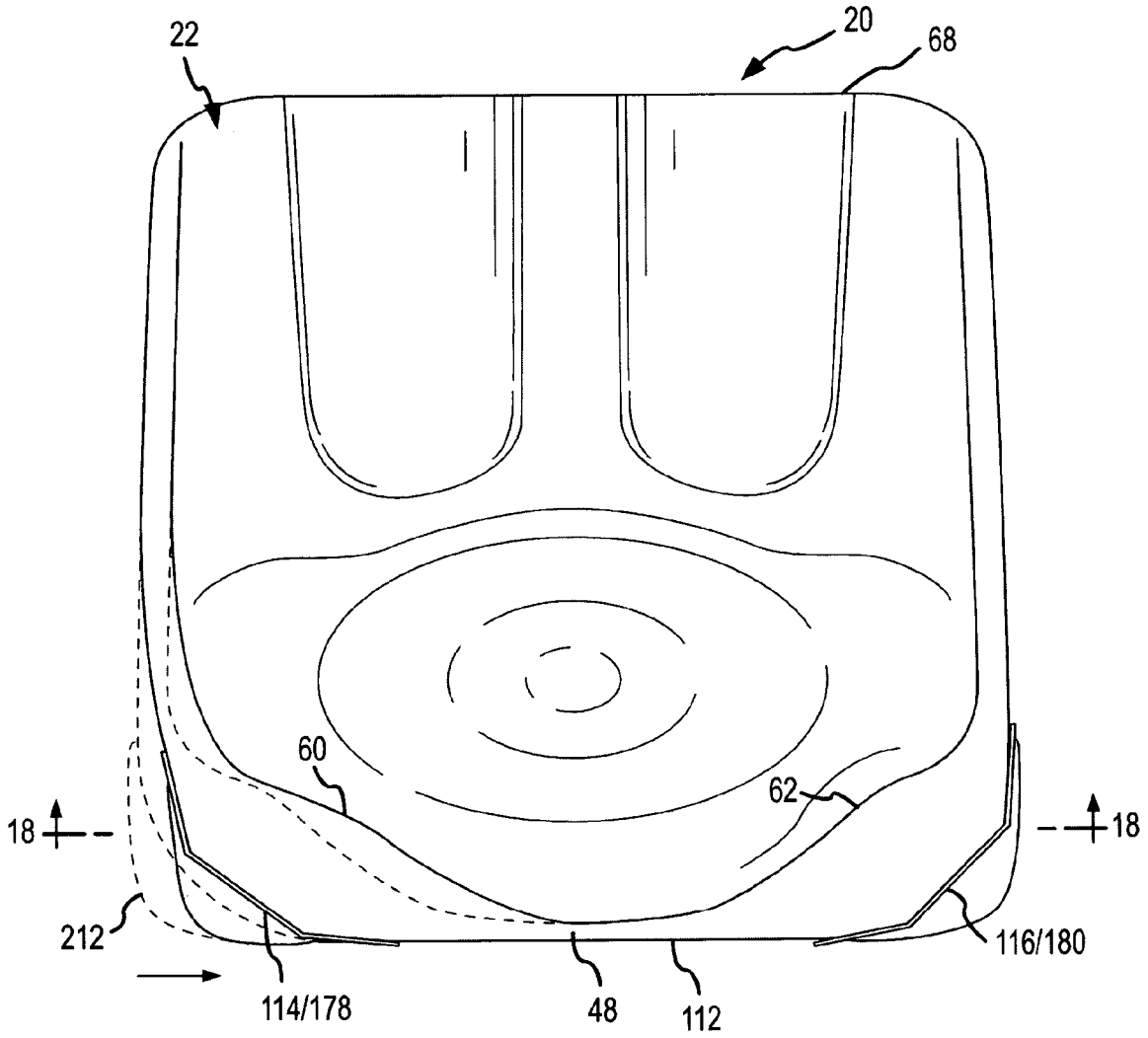
FIG. 17 is a plan view of the seat cushions shown in FIGS. 10 and 15, showing an adjustment and deformation of a portion of a support contour of the seat cushion to a position shown by solid lines compared to an undeformed position shown by dashed lines.
Figure 18:
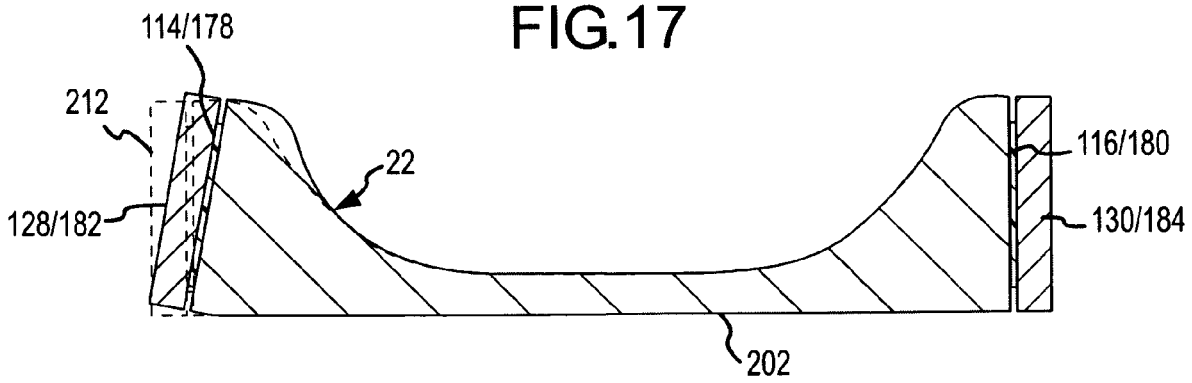
FIG. 18 is a cross-sectional view taken substantially in the plane of line 18—18 of FIG. 17.

The effect of tightening the transverse strap 104 or 174 is shown in FIGS. 17 and 18, where moving the corner support member 114 or 178 transversely inward results in moving the support area 60 of the rear wall of the cushion 20 transversely inward.

To tighten the transverse strap 104, the pull loop 164 end of the strap end portion 104B is pulled toward the opposite side 110 of the cushion 20. As the transverse strap end portion 104B is pulled, the strap 104B moves through the buckle 156, and the buckle 156 and the support member 114 are pulled toward the opposite side 110. Since the support member 114 is pivotally connected to the transverse brace 122, the support member 114 is pulled toward the opposite side 110 and the support member 114 rotates about the pivot joint 124 and moves the support area 60 generally transversely inward. Connecting the transverse straps 104 and 106 between the support members 114 and 116 and the opposite ends of the transverse brace 122, as shown in FIG. 2, allows the support members 114 and 116 to be adjusted substantially independently from one another.

To tighten the transverse strap 174, the free end portion 174*b* is moved away from the connection end portion 174*a*, and the free end portion 174*b* Is then pulled slightly toward the opposite side 110 of the cushion 20. As the free end portion 174*b* is moved laterally, the transverse strap 174 moves through the rear slot 190 and moves the support member 178 slightly toward the opposite side 110 of the cushion 20. The free end portion 174*b* is thereafter reattached to the connected end portion 174*a*.

The tension force applied by the transverse strap 104 causes the corner support member 114 to exert laterally inward pressure on the rear wall 48 of the seat cushion 20 and to deform the shape of the seat cushion 20 in the manner shown by the solid lines in FIG. 17 compared to the undeformed or original position of the cushion shown by dashed lines 212. The transverse brace 122 transversely restrains the lower portion of the support member 114 so that the support member 114 primarily deforms the support contour 22 of the seat cushion 20 and not the bottom surface 202.

Tension force applied by the transverse strap 174 also causes the corner support member 178 to exert transversely inward pressure on the rear wall 48 of the seat cushion 20 to deform the shape of the seat cushion 20 in a manner similar to that shown in FIG. 17. However, tension force applied by the transverse strap 174 may transversely compress the bottom surface 202 in a manner similar to the longitudinal compression shown in FIGS. 20 and 21.

Moving the support area 60 laterally inward as shown in FIG. 17 causes more pressure to be applied to the tissue of the left posterior lateral buttocks. Moving the corner support member 116 or 180 transversely inward results in moving the support area 62 inward due to the curvature of the support contour 22 along the rear wall 48.

Figure 19:
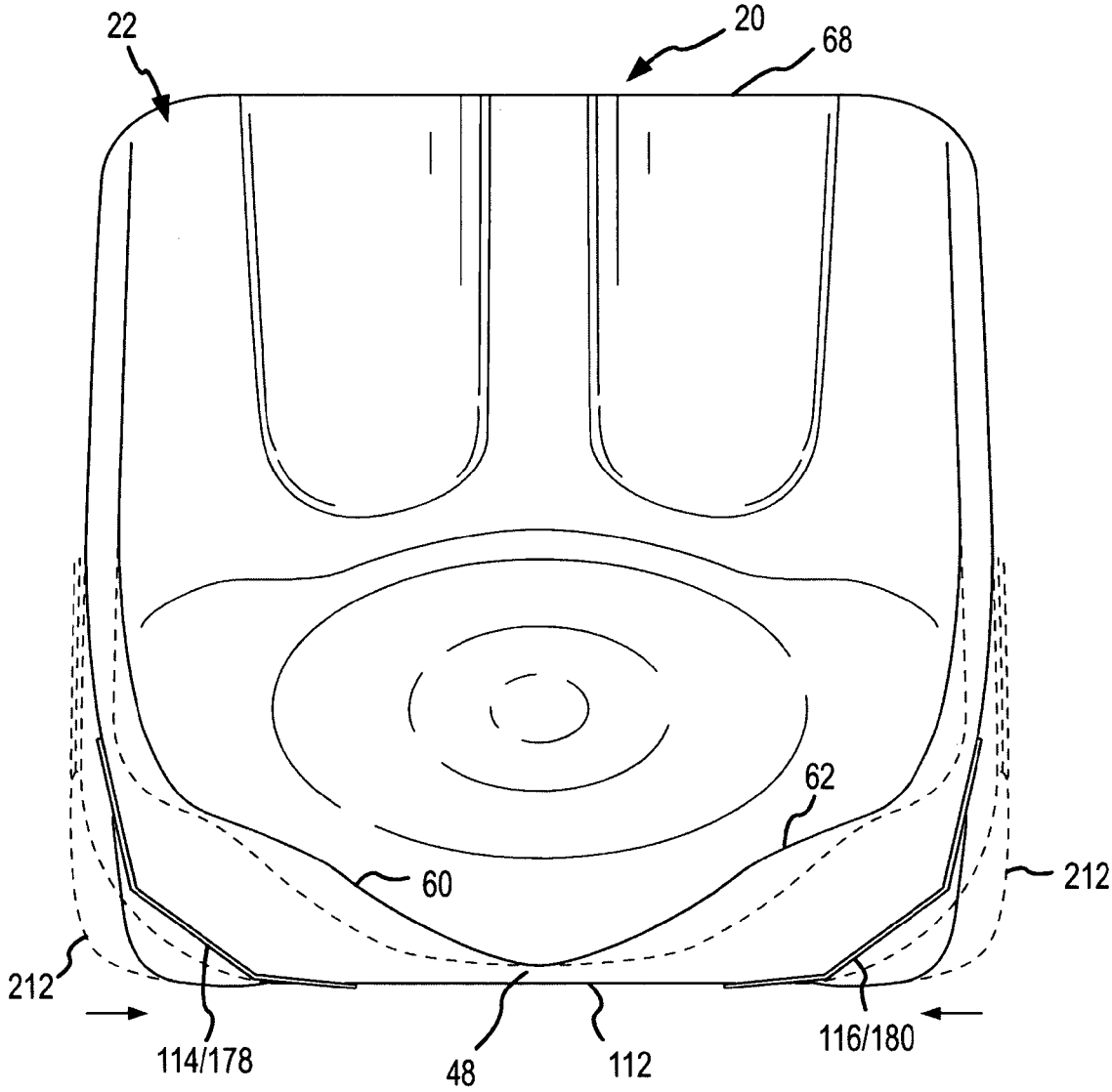
FIG. 19 is a plan view of the seat cushion shown in FIGS. 10 and 15, showing another type of adjustment and deformation of a portion of a support contour of the seat cushion to a position shown by solid lines compared to an undeformed position shown by dashed lines.

The other support member 116 can be moved laterally inward, as shown in FIG. 19, in the same manner as the support member 114 is moved laterally inward as shown in FIGS. 17 and 18. Similarly, support member 180 can be moved laterally inward in the same manner as the support member 178. Movement of the support member 116 and 180 is achieved as a result of adjusting the adjustment straps 106 and 176 in the same manner as has been described in conjunction with adjusting the adjustment strap 104 and 174, respectively. Adjustment of the support member 116 and 180 moves the support area 62 inward due to the curvature of the support contour 22 along the rear wall 48 and deforms the shape of the seat cushion as shown in FIG. 19 by the solid lines compared to the dashed lines 212.

Figure 20:
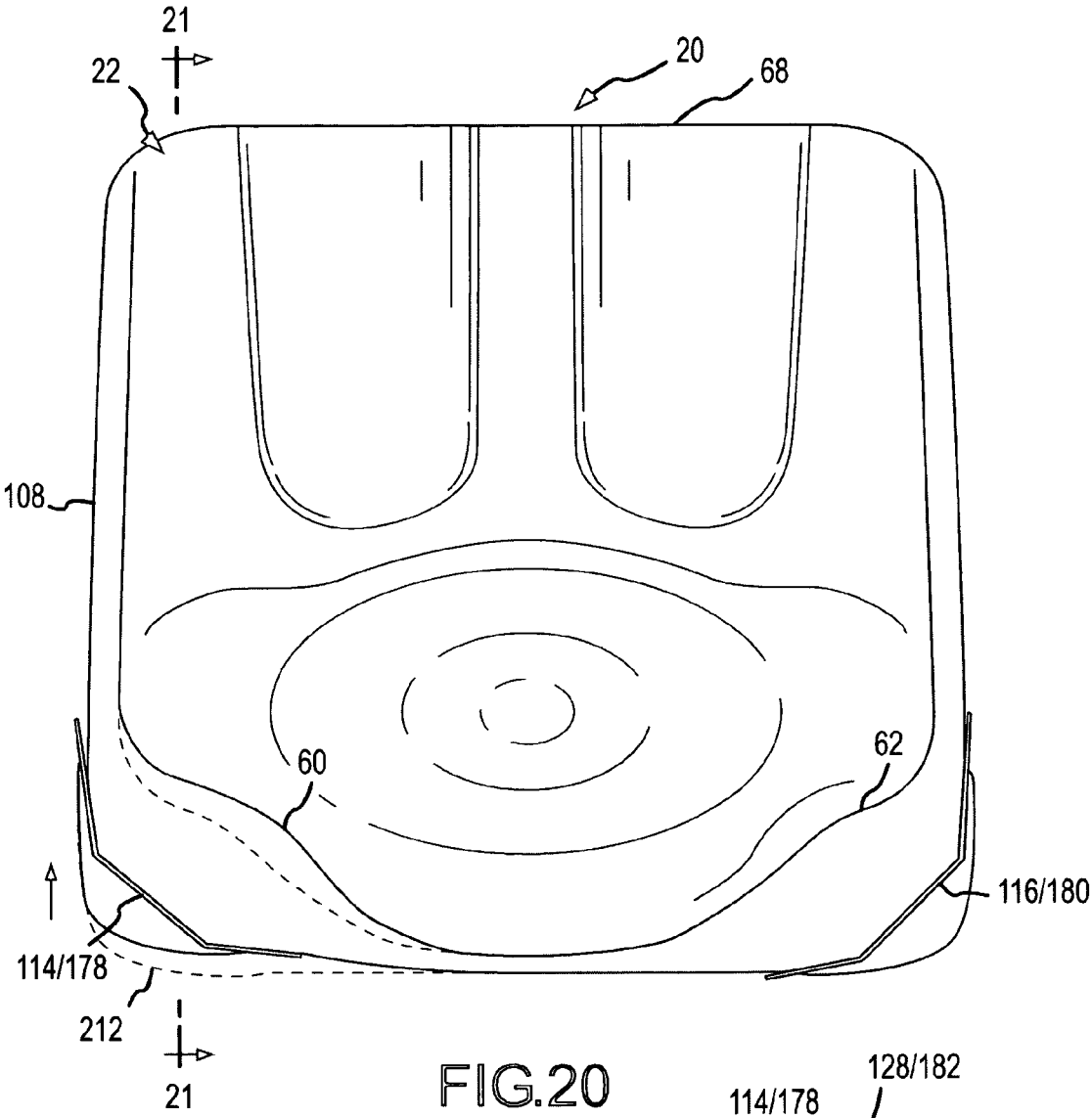
FIG. 20 is a plan view of the seat cushion shown in FIGS. 10 and 15, showing another type of adjustment and deformation of a portion of a support contour of the seat cushion to a position shown by solid lines compared to an undeformed position shown by dashed lines.
Figure 21:
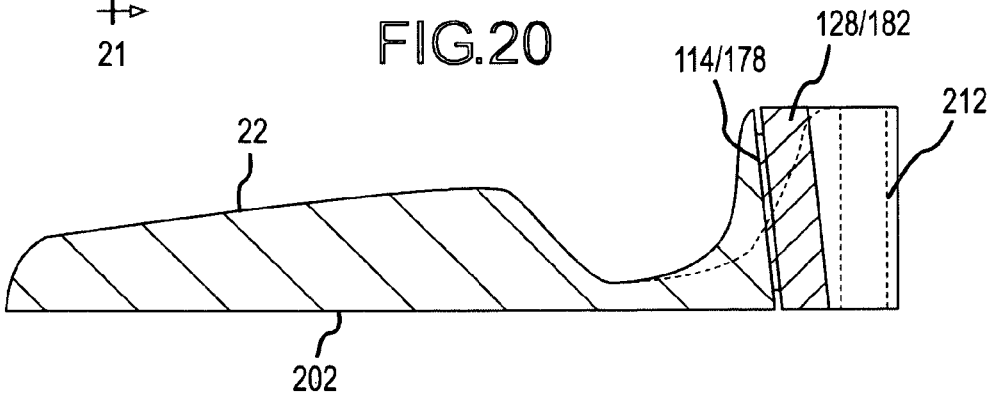
FIG. 21 is a cross-sectional view taken substantially in the plane of line 21—21 of FIG. 20.

Tightening the longitudinal straps 100 or 170 shortens the taut length of the longitudinal strap 100 and 170, causing the support member 114 or 178 and the support area 60 to be moved forward, as shown in FIGS. 20 and 21. The forward movement of the support member 114 or 178 causes the support area 60 to move forward toward the front edge 68 of the seat cushion 20 as shown by solid lines compared to the dashed lines 212 in FIGS. 20 and 21. Moving the support area 60 forward in this manner causes the support area 60 to apply more pressure to the broad tissue mass which rotates the pelvic bone 42 more forward.

Figure 22:
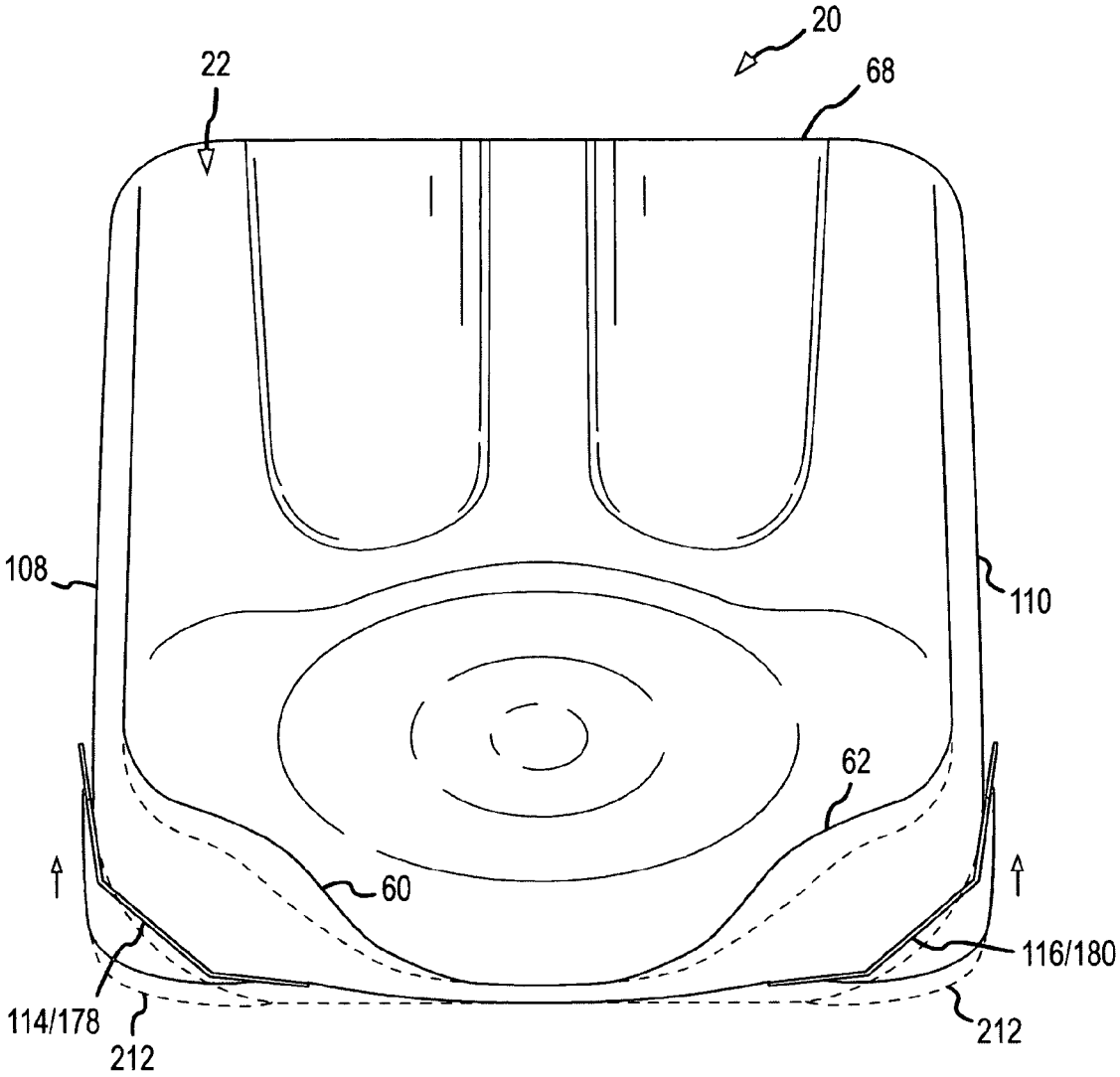
FIG. 22 is a plan view of the seat cushion shown in FIGS. 10 and 15, showing another type of adjustment and deformation of a portion of a support contour of the seat cushion to a position shown by solid lines compared to an undeformed position shown by dashed lines.

Tightening the longitudinal straps 100 and 102 or 170 and 172 on the sides 108 and 110 simultaneously moves both of the support members 114 and 116 or 178 and 180 forward, shown by the solid lines compared to the dashed lines in FIG. 22. The buckles 152 and 154 retain the relative forward positions of the support members 114 and 116 while reattaching the forward free end portions of the longitudinal straps 170 and 172 to the attachment strips 198 and 200 retains the relative forward positions of the support members 178 and 180.

A shortening adjustment of the taut portions of the longitudinal straps 100 and 102 or 170 and 172 rotates the pelvic area 24 slightly forwardly. By applying more force on the posterior lateral buttocks with the support areas 60 and 62, the pelvic area 24 is made to tilt more forward, causing the ischial tuberosities 30 to be move slightly rearwardly. In this way, the ischial tuberosities can be more precisely positioned over the lowermost surface area 32. By moving the support areas 60 and 62 transversely inward the vertical clearance 34 can be maintained.

Figure 23:
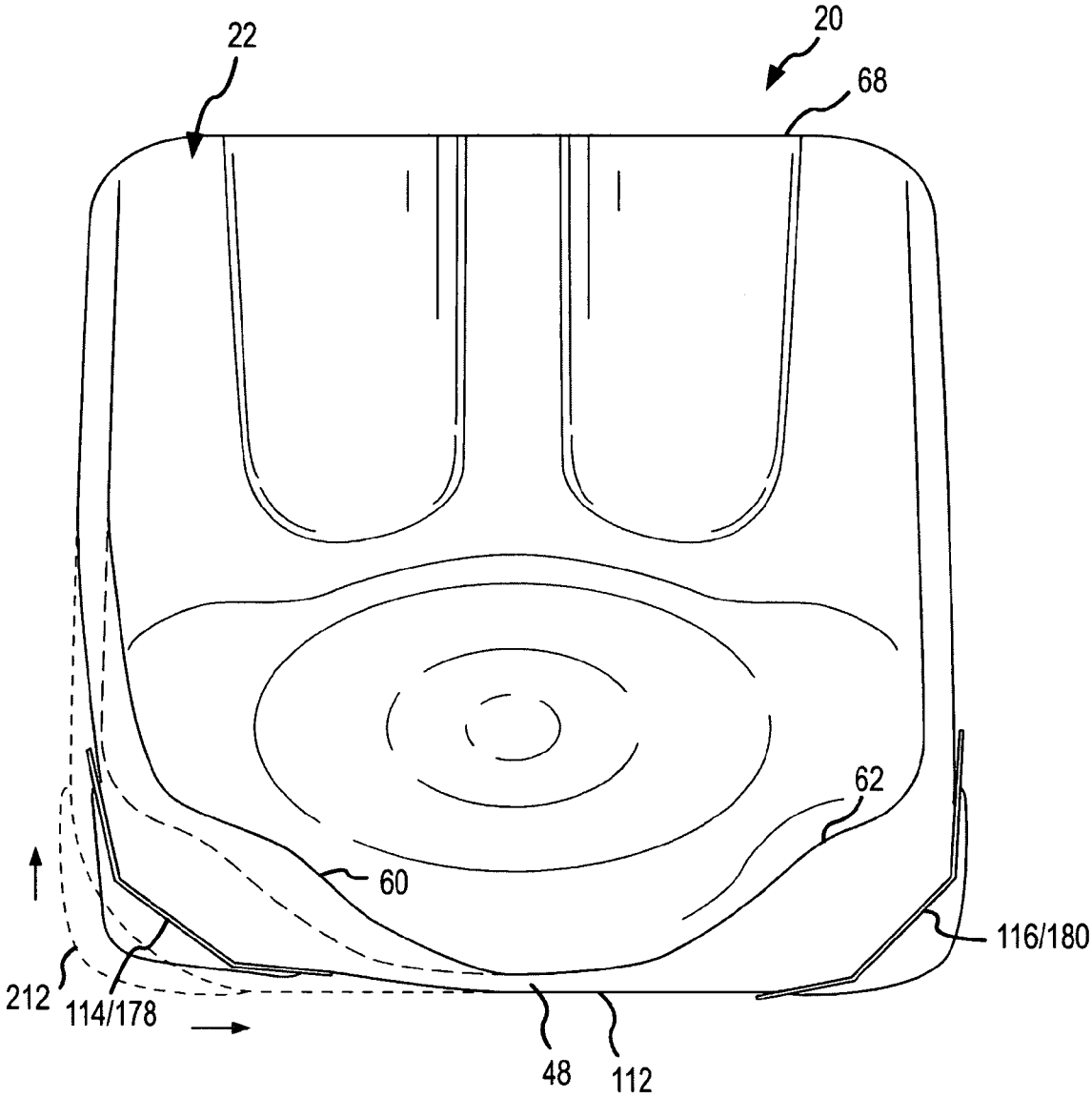
FIG. 23 is a plan view of the seat cushion shown in FIGS. 10 and 15, showing another type of adjustment and deformation of a portion of a support contour of the seat cushion to a position shown by solid lines compared to an undeformed position shown by dashed lines.
Figure 24:
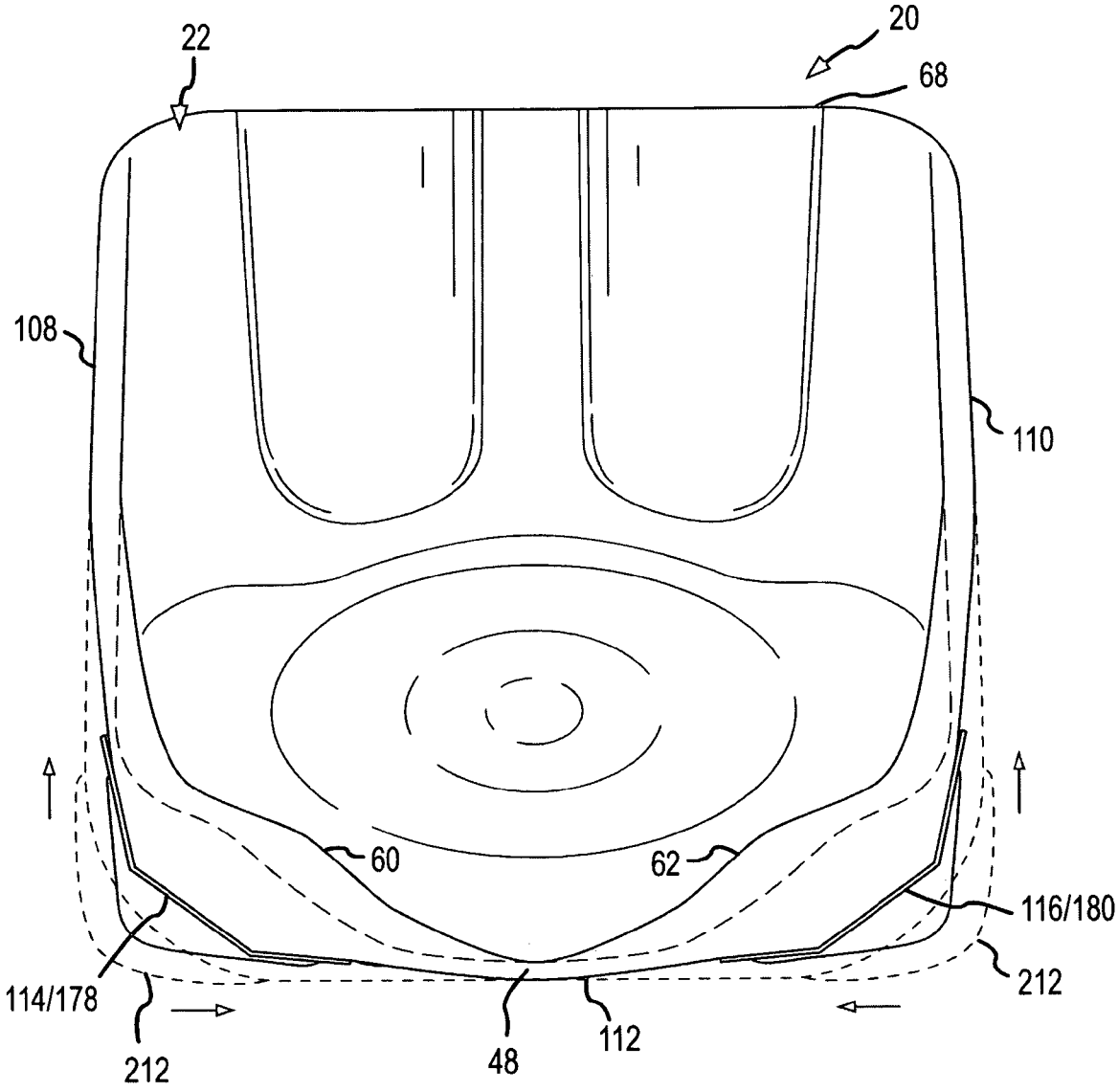
FIG. 24 is a plan view of the seat cushion shown in FIGS. 10 and 15, showing another type of adjustment and deformation of a portion of a support contour of the seat cushion to a position shown by solid lines compared to an undeformed position shown by dashed lines.

In addition to moving the corner support members 114 and 116 or 178 and 180 in a single direction transversely inward or forward, the corner support members 114 and 116 or 178 and 180 are movable in combinations of both transverse and forward directions as shown by solid lines in FIGS. 23 and 24, with the dashed lines 212 representing the unadjusted seat cushion periphery. Any of the straps 100, 102, 104 and 106 or 170, 172, 174 and 176 can be adjusted independently of the other to move the transverse location of the support areas 60 and 62 respectively. This allows the contour 22 to be adjusted to provide individualized support and alignment of the pelvic area 24. Combinations of adjustments to the longitudinal straps 100 and 102 or 170 and 172 in conjunction with adjustments to the transverse straps 104 and 106 or 174 and 176 allows a large variety of adjustments to the shape of the support contour 22, and related adjustment of the amount of pressure from the support areas 60, 62, 64 and 66 on the pelvic anatomy of the person sitting on the cushion. Combinations of adjustments from the straps 100, 102, 104 and 106 or 170, 172, 174 and 176 also adjusts the contour 22 to offload pressure from the areas more prone to pressure ulcers.

Changing the shape of the support contour 22 provides the ability to adjust the contour 22 to the particular needs of an individual user. By adjusting the corner support members 114 and 116 or 178 and 180, the relative locations of the support areas 60, 62, 64 and 66 is adjusted. In addition, by changing the location of the support areas 60, 62, 64 and 66, the position of the users ischial tuberosities 30, greater trochanters 38, coccyx 50 and sacrum 52 relative to the support contour 22 of the seat cushion 20 is adjusted. In particular, moving the corner support members 114 and 116 or 178 and 180 forward affects the vertical clearance 34 between the users ischial tuberosities 30 and the lowermost surface area 32 as well as the longitudinal clearance 35 (FIG. 4). Moreover, moving the corner support members 114 and 116 or 178 and 180 forward effects the horizontal clearance 54 between the recessed channel area 46 and the coccyx 50 and sacrum 52.

One advantage to the support contour adjustability provided by the present invention is that the adjustments of the straps 100, 102, 104 and 106 or 170, 172, 174 and 176 might be made while the user is seated on the seat cushion 20 in the wheelchair. Adjustment while the user sits on the cushion allows the user to experience the effect of the adjustment as it is being made and immediately determine if the adjustment has improved the fit of the cushion 20. In some cases, it may be possible for the wheelchair user himself or herself to make the adjustments by pulling on the free ends of the adjustment straps 100, 102, 104 and 106 or 170, 172, 174 and 176. Of course the adjustment straps must be accessible, and a cover (not shown) which envelops the seat cushion 20 may be provided with openings to allow access to the free ends of the adjustment straps.

Many of the same considerations applicable to wheelchair users and wheelchair seat cushions are also applicable with varying levels of criticality to other types of seat cushions used in other seating applications and environments. For example, seat cushions used in office chairs are required to support the user for relatively long periods of time in a comfortable manner which encourages proper postural alignment and without creating risks of medical problems, for example postural deformity and pain. The support contour 22 will adapt to accommodate the support and postural needs of individuals in many different seating applications and environments. Many other advantages and improvements will be apparent after gaining a full appreciation of the present invention.

A presently preferred embodiment of the present invention and many of its improvements have been described with a degree of particularity. This description is a preferred example of implementing the invention, and is not necessarily intended to limit the scope of the invention. The scope of the invention is defined by the following claims.

What is claimed:

1. A flexible seat cushion for supporting a person in a seated position thereon, having generally transversely spaced and longitudinally extending longitudinal sides and generally longitudinally spaced and transversely extending front and rear transverse sides, the longitudinal sides intersecting the rear side at rear corners and the longitudinal sides intersecting the front side at front corners, and an upper surface extending between the sides and defining a support contour for contacting and supporting a person in a sitting position, comprising;

a support contour, including relief areas at locations adjacent to skin covering at least one bony prominence of a pelvic area of the person seated on the cushion, and support areas adjacent to skin covering tissue masses adjacent to the one bony prominence, the relief areas and support areas positioned to establish relatively less pressure on the skin in the relief areas and relatively more pressure on the skin in the support areas, the relief areas including a center cavity generally transversely centered between the longitudinal sides and longitudinally spaced more toward the rear side than the front side;

a support member attached to a rear corner of the flexible seat cushion, the support member having relatively less flexibility than the seat cushion to resist deformation of the support contour from contact with the pelvic area of the person when seated on the seat cushion;

a connector member connected to the support member and extending along one of the longitudinal sides or the rear side which intersect at the rear corner, the connector member having a length that is adjustable to move the support member in a direction substantially parallel to one side along which the connector member extends, the connector member comprises a strap having first and second portions, the first portion of the strap is connected to the support member, the second portion of the strap is connected to the one side along which the connector member extends, the strap includes a fastener, and the first and second portions are interconnected by the fastener.

2. A seat cushion as defined in claim 1, wherein:

a functional length of the strap is adjustable.

3. A seat cushion as defined in claim 2, wherein:

the fastener connects the first and second portions at a plurality of selected positions to adjust the functional length of the strap.

4. A seat cushion as defined in claim 3, wherein:

the fastener comprises a buckle.

5. A seat cushion as defined in claim 4, wherein:

the buckle connects the first and the second portions of the strap; and the buckle is fixed to one of the first or second portions of the strap, and the buckle holds the other one of the first or second portions of the strap to adjust the functional length of the strap.

6. A seat cushion as defined in claim 5, wherein:

the buckle holds the other one of the first or second portions by friction.

7. A flexible seat cushion for supporting a person in a seated position thereon, having generally transversely spaced and longitudinally extending longitudinal sides and generally longitudinally spaced and transversely extending front and rear transverse sides, the longitudinal sides intersecting the rear side at rear corners and the longitudinal sides intersecting the front side at front corners, and an upper surface extending between the sides and defining a support contour for contacting and supporting a person in a sitting position, comprising;

a support contour, including relief areas at locations adjacent to skin covering at least one bony prominence of a pelvic area of the person seated on the cushion, and support areas adjacent to skin covering tissue masses adjacent to the one bony prominence, the relief areas and support areas positioned to establish relatively less pressure on the skin in the relief areas and relatively more pressure on the skin in the support areas, the relief areas including a center cavity generally transversely centered between the longitudinal sides and longitudinally spaced more toward the rear side than the front side;

a support member attached to a rear corner of the flexible seat cushion, the support member having relatively less flexibility than the seat cushion to resist deformation of the support contour from contact with the pelvic area of the person when seated on the seat cushion;

a connector member connected to the support member and extending along one of the longitudinal sides or the rear side which intersect at the rear corner, the connector member having a length that is adjustable to move the support member in a direction substantially parallel to one side along which the connector member extends, the connector member comprises a strap having first and second portions, the first portion of the strap is connected to the support member, the second portion of the strap is connected at a position along the one side along which the connector member extends, and the position along the one side at which the second portion of the strap is connected is adjustable.

8. A seat cushion as defined in claim 7, wherein:

the second portion of the strap is connected in the position along the one side by a hook and loop fastener.

9. A flexible seat cushion for supporting a person in a seated position thereon, having generally transversely spaced and longitudinally extending longitudinal sides and generally longitudinally spaced and transversely extending front and rear transverse sides, the longitudinal sides intersecting the rear side at rear corners and the longitudinal sides intersecting the front side at front corners, and an upper surface extending between the sides and defining a support contour for contacting and supporting a person in a sitting position, comprising;

a support contour, including relief areas at locations adjacent to skin covering at least one bony prominence of a pelvic area of the person seated on the cushion, and support areas adjacent to skin covering tissue masses adjacent to the one bony prominence, the relief areas and support areas positioned to establish relatively less pressure on the skin in the relief areas and relatively more pressure on the skin in the support areas, the relief areas including a center cavity generally transversely centered between the longitudinal sides and longitudinally spaced more toward the rear side than the front side;

a support member attached to a rear corner of the flexible seat cushion, the support member having relatively less flexibility than the seat cushion to resist deformation of the support contour from contact with the pelvic area of the person when seated on the seat cushion;

a first connector member connected to the support member and extending along one longitudinal side; and a second connector member connected to the support member and extending along the rear transverse side; and the first and second connector members connect to the same support member at the rear corner adjacent to the center cavity.

10. A seat cushion as defined in claim 9, wherein:

the first and second connector members have functional lengths that are adjustable independently of one another to move the support member in a direction parallel to the extension of the longitudinal and rear transverse sides, respectively; and adjustment of a functional length of either one of the connector members changes the shape of the support contour at the cavity where the support member is located.

11. A seat cushion as defined in claim 10, wherein the bony prominences of the pelvic area include ischial tuberosities and coccyx and sacrum, and wherein the seat cushion includes:

a back wall surrounding the rear pelvic area of the person, the back wall defining a portion of the center cavity of the support contour, the transversely extending rear side of the cushion including the back wall; and wherein:

the center cavity is located directly below the ischial tuberosities of the person sitting when on the support contour, the cavity curving downwardly and longitudinally forwardly and transversely inwardly from the back wall to a generally horizontal lowermost surface area of the cavity, the lowermost surface area of the cavity is at a location vertically spaced below the ischial tuberosities and has longitudinal and transverse dimensions relative to the ischial tuberosities to establish the relatively less pressure on the skin covering the ischial tuberosities during movement within an anticipated range of forward, backward and side to side movement of an upper torso of the person sitting on the support contour, the lowermost surface area constituting one relief area of the support contour;

a channel area located directly behind the coccyx and sacrum of the person sitting on the support contour, the channel area extending downwardly and longitudinally forwardly from the back wall toward the lowermost surface area of the cavity at a transverse midline of the support contour, the channel area has dimensions extending longitudinally and transversely relative to the coccyx and sacrum to establish the relatively less pressure on the skin covering the coccyx and sacrum during an anticipated range of normal movement of the pelvic area of the person while sitting on the support contour, the channel area constituting a relief area;

at least one pelvic protrusion area located adjacent the skin covering the tissue masses at the opposite lateral posterior buttocks of the person sitting on the support contour, each pelvic protrusion area located at transversely oppositely spaced positions from the channel area, each pelvic protrusion area generally curving vertically downwardly and transversely and longitudinally inwardly from the back wall toward the lowermost surface area, each pelvic protrusion area terminating vertically above the lowermost surface area, each pelvic protrusion area defining a forwardly and upwardly facing contact surface to contact the skin covering the tissue masses at the lateral posterior buttocks, the forwardly and upwardly facing contact surfaces transferring force to the tissue masses at the opposite posterior buttocks to offload pressure from the skin covering the coccyx and sacrum while the person is sitting on the support contour, each pelvic protrusion area constituting a support area; and wherein:

the contact surfaces of the protrusion areas extend forwardly into the cavity compared to the channel area; and shortening a functional length of the second connector member moves the pelvic protrusion area adjacent to the support member relatively more transversely inward toward the pelvic area of the user.

12. A seat cushion as defined in claim 11, wherein the bony prominences of the pelvic area also include greater trochanters, and wherein the seat cushion further includes:

a lateral area on each opposite transverse side of the cavity and located transversely to the outside of and vertically below the greater trochanters of the person sitting on the support contour, each lateral area generally curving vertically downwardly and transversely inwardly from an outer periphery of the support contour to intersect transverse opposite sides of the cavity at a position above the ischial tuberosities of the person sitting on the support contour, the lateral areas also extending longitudinally relative to the greater trochanters of the person sitting on the support contour, the lateral areas having sufficient longitudinal, transverse and vertical dimensions to establish the relatively less pressure on the skin covering the greater trochanters during movement within an anticipated range of different contacting support positions of the person on the support contour, each lateral area constituting one relief area; and a posterior thigh protrusion area located beneath the skin covering the tissue masses at the posterior thighs of the person sitting on the support contour, each posterior thigh protrusion area located on transversely oppositely sides of a longitudinal midline through the support contour, each posterior thigh protrusion area positioned vertically above and longitudinally forward of each lateral area, each posterior thigh protrusion area defining an upwardly facing fulcrum-like contact surface at a posterior position of the thigh leg bone, the posterior thigh protrusion areas have sufficient longitudinal, transverse and vertical dimensions to establish the relatively greater pressure on the skin covering the tissue masses at the posterior thighs, the fulcrum-like contact surfaces transferring force from the legs distal to the proximal thighs in a lever-like manner through the thigh bones to elevate the greater trochanters relative to the lateral areas while the person is sitting on the support contour, each posterior thigh protrusion area constitutes a support area; and wherein:

shortening a functional length of the first connector member moves the pelvic protrusion area adjacent to the support member relatively more forward toward the pelvic area of the user.

13. A seat cushion comprising a resilient seat support structure having longitudinally-extending and transversely-extending sides intersecting at corners and defining an upward facing support contour extending between the sides to contact and support a person in a sitting position, comprising:

relief areas defined by the support contour and positioned adjacent to skin covering the ischial tuberosities, the greater trochanters and the coccyx and sacrum of a pelvic area of the person sitting on the support contour;

support areas defined by the support contour and positioned adjacent to skin covering tissue masses on opposite lateral sides of the posterior buttocks and beneath the proximal thighs of the person;

a support member positioned at a corner where a longitudinally-extending and a rear transversely-extending sidewall of the seat support structure intersect, the support member being relatively less flexible than the seat support structure to resist deformation of the support contour when contacted by the person seated on the seat cushion;

a longitudinal connector member that connects the support member to a longitudinally extending side of the seat support structure at a position longitudinally spaced from the corner where the support member is located, the longitudinal connector member restraining the support member to resist longitudinal deformation of the support contour at the corner where the support member is located;

a transverse connector member that connects the support member to a rear transverse extending side of the seat support structure at a position transversely spaced from the corner where the support member is located, the transverse connector member restraining the support member to resist transverse deformation of the support contour at the corner where the support member is located; and wherein:

the relief areas and support areas are spaced relatively more away from and relatively more toward the pelvic area of the person, respectively, to establish relatively less pressure on the skin in the relief areas and relatively more pressure on the skin in the support areas and the support member supports the corner of the seat support structure to assist in maintaining the support contour of the seat support structure at the corner.

14. A seat cushion as defined in claim 13, wherein the longitudinal connector member adjusts to move longitudinally the support member and a portion of the seat support structure at the corner where the support member is located to alter the support contour.

15. A seat cushion as defined in claim 14, wherein the transverse connector member adjusts to move transversely the support member and a portion of the seat support structure at the corner where the support member is located to alter the support contour.

16. A seat cushion as defined in claim 13, wherein the transverse connector member adjusts to move transversely the support member and a portion of the seat support structure at the corner where the support member is located to alter the support contour.

17. A seat cushion as defined in claim 13, wherein one of the longitudinal or transverse connector members adjusts to move the support member and a portion of the seat support structure at the corner where the support member is located to alter the support contour.

18. A seat cushion as defined in claim 17, wherein the movement of the support member compresses a part of the seat support structure at the corner where the support member is located to alter the support contour at that location.

19. A seat cushion as defined in claim 13, wherein:

the support member is positioned at a first corner of the seat support structure, the support member positioned at the first corner being a first support member; the longitudinal connector member connecting to the first support member being a first longitudinal connector member, the transverse connector member connecting to the first support member being a first transverse connector member; and further comprising:

a second support member positioned at a second corner of the seat support structure;

a second longitudinal connector member that connects the second support member to the other of longitudinally extending sides of the seat support structure which is opposite of the one longitudinally extending side to which the first longitudinal connector member is connected;

a second transverse connector member that connects the second support member to the same rear transverse extending side of the seat support structure to which the first transverse connector member is connected; and wherein:

the first and second support members reinforce the flexible seat support structure to maintain the support contour against significant deformation at the first and second corners in response to the user sitting on the cushion.

20. A seat cushion as defined in claim 19, wherein the first and second support members are moveable independently of each other.

21. A seat cushion as defined in claim 19, wherein the connector members comprise straps and the first and second longitudinal connector members are formed by portions of a single continuous strap.

22. A seat cushion as defined in claim 21, wherein a portion of the single continuous strap is connected to a bottom surface of the seat support structure.

23. A seat cushion as defined in claim 13, wherein the longitudinal connector member and the transverse connector member connector comprise straps.

24. A seat cushion as defined in claim 23, wherein the straps are made from nylon.

25. A seat cushion as defined in claim 23, wherein the straps include end portions that are connected together with hook and loop fasteners.

26. A seat cushion as defined in claim 25, wherein the transverse connector member connects to itself with hook and loop connectors to connect the support member to the rear transverse extending side of the seat support structure.

27. A seat cushion as defined in claim 25, further comprising:

an attachment strip that is connected to one of the longitudinally or rear transverse extending sides of the seat support structure, and wherein the connector member on the one of the longitudinally or rear transverse extending side connects to the attachment strip.

28. A seat cushion as defined in claim 23, further comprising:

a slotted connector pivotally connected to the support member and connecting the support member to one of the longitudinal or transverse connector members.

29. A seat cushion as defined in claim 23, further comprising:

a slot defined within the support member; and wherein:

one of the longitudinal or transverse connector member loops through the slot to connect the support member to the seat support structure.

30. A seat cushion as defined in claim 19, further comprising:

a brace connected to extend a distance between a first point on the first support member and a second point on the second support member and to maintain the distance between the first point and the second point.

31. A seat cushion as defined in claim 30, wherein:

the connector members have functional lengths that are adjustable, the seat cushion further comprising:

a pivot joint connecting the first support member to the brace to allow the first transverse connector member to pivot the first support member transversely with respect to the brace by adjusting the functional length of the first transverse connector member; and wherein:

the first support member is pivoted longitudinally by adjusting the functional length of the first longitudinal connector member.

32. A seat cushion as defined in claim 31, wherein:

the pivot joint connecting the first support member to the brace is the first pivot joint, the seat cushion further comprising:

a second pivot joint connecting the second support member to the brace to allow the second transverse connector member to pivot the second support member transversely with respect to the brace by adjusting the functional length of the second transverse connector member; and wherein:

the second support member is pivoted longitudinally by adjusting the functional length of the second longitudinal connector member.

33. A seat cushion as defined in claim 32, wherein:

the first transverse connector member connects to the first support member and to the second pivot joint.

34. A seat cushion as defined in claim 32, wherein:

the second transverse connector member connects to the second support member and to the first pivot joint.

* * * * *